US012559874B2

(12) United States Patent
Jameson et al.

(10) Patent No.: US 12,559,874 B2
(45) Date of Patent: Feb. 24, 2026

(54) SEWING APPARATUS

(71) Applicant: Spin Master Ltd., Toronto (CA)

(72) Inventors: Mollie B. Jameson, Toronto (CA); Stephanie Fung, Toronto (CA); Matthew Lentini, Toronto (CA); Graham D. Browning, Toronto (CA)

(73) Assignee: SPIN MASTER LTD., Toronto (CA)

( * ) Notice: Subject to any disclaimer, the term of this patent is extended or adjusted under 35 U.S.C. 154(b) by 512 days.

(21) Appl. No.: 18/148,156

(22) Filed: Dec. 29, 2022

(65) Prior Publication Data

US 2023/0212801 A1 Jul. 6, 2023

Related U.S. Application Data

(60) Provisional application No. 63/266,203, filed on Dec. 30, 2021.

(51) Int. Cl.
*D05B 1/06* (2006.01)
*D05B 47/00* (2006.01)
(Continued)

(52) U.S. Cl.
CPC ..... *D05B 1/06* (2013.01); *D05B 47/00* (2013.01); *D05B 55/00* (2013.01); *D05B 63/00* (2013.01);
(Continued)

(58) Field of Classification Search
CPC ..... D05B 1/06; D05B 55/00; D05B 55/14; D05B 63/00; D05B 37/08; D05B 37/04–063; D05B 65/00; D05B 65/003
See application file for complete search history.

(56) References Cited

U.S. PATENT DOCUMENTS 2,591,447 A * 4/1952 Loomis ..... D05B 65/003 112/299
3,834,974 A 9/1974 Dunn et al.
(Continued)

FOREIGN PATENT DOCUMENTS

CN 204690269 U 10/2015
CN 108301144 A 7/2018
(Continued)

OTHER PUBLICATIONS

CN108301144—English Translation.
(Continued)

*Primary Examiner* — Nathan E Durham
(74) *Attorney, Agent, or Firm* — Aird & McBurney LP

(57) ABSTRACT

A sewing apparatus for applying a stitch of thread to a piece of fabric is provided. The apparatus housing includes a platform for supporting a piece of fabric, and contains a grasping member that is moved to grasp and release a thread segment fed through the housing by a needle holder. The needle holder is positioned to hold a needle that has a needle aperture for pass-through, therethrough of the thread segment, and is movable between a withdrawn position, and an advanced position in which the needle holder drives the needle through the piece of fabric to bring the thread segment into position for grasping by the grasping member. The sewing apparatus also including a needle holder driver for driving the movement of the needle holder and a thread puller for pulling the thread segment to an exterior of the housing for a user to cut.

11 Claims, 22 Drawing Sheets

(51) Int. Cl.

| | |
|---|---|
| ***D05B 55/00*** | (2006.01) |
| ***D05B 63/00*** | (2006.01) |
| ***D05B 69/10*** | (2006.01) |
| ***D05B 69/24*** | (2006.01) |
| ***D05B 69/36*** | (2006.01) |

(52) U.S. Cl.
CPC ..... *D05B 69/10* (2013.01); *D05B 69/24* (2013.01); *D05B 69/36* (2013.01)

(56) References Cited

U.S. PATENT DOCUMENTS

| | | | | |
|---|---|---|---|---|
| 4,060,044 | A | 11/1977 | Kuramochi | |
| 4,077,339 | A | 3/1978 | Bass et al. | |
| 4,100,867 | A | 7/1978 | Bass et al. | |
| 4,274,349 | A | 6/1981 | Doyel | |
| 4,319,532 | A | 3/1982 | Fogarty et al. | |
| 4,538,535 | A * | 9/1985 | Hanyu ..... | D06B 3/045 112/80.71 |
| 5,304,089 | A | 4/1994 | Danielian | |
| 5,660,127 | A | 8/1997 | Yamashita et al. | |
| 7,891,307 | B2 | 2/2011 | Sakuma et al. | |
| 8,661,997 | B2 | 3/2014 | Sakuma et al. | |
| 10,151,056 | B2 | 12/2018 | Yamazaki | |

FOREIGN PATENT DOCUMENTS

| | | | |
|---|---|---|---|
| CN | 207845976 | U | 9/2018 |
| CN | 207970465 | U | 10/2018 |
| EM | 0012511510001 | | 1/2011 |
| GB | 695165 | A | 8/1953 |
| JP | 137340 | S | 8/1958 |
| JP | 722097 | S | 8/1987 |
| JP | 1144440 | S | 6/2002 |
| JP | 1210810 | S | 5/2004 |
| JP | 2004222896 | A | 8/2004 |
| JP | 1242497 | S | 4/2005 |
| JP | 1242701 | S | 4/2005 |
| JP | 2005349067 | A | 12/2005 |
| JP | 200939222 | A | 2/2009 |
| JP | 201047885 | A | 3/2010 |
| JP | 5945050 | B1 | 7/2016 |
| WO | 2016151969 | A1 | 9/2016 |

OTHER PUBLICATIONS

CN204690269U—English translation.
CN207845976U—English translation.
CN207970465U—English translation.
JP Appln. 2022-006455, Notice: Information related to the prior design search & English translation, Sep. 13, 2022, Japanese Patent Office 2022.
JP Appln. 2022-006456, Notice: Information related to the prior design search & English translation, Sep. 13, 2022, Japanese Patent Office 2022.
JP1144440—English Translation.
JP1210810—English Translation.
JP1242497—English Translation.
JP1242701—English Translation.
JP2004222896A—English translation.
JP2005-349067A—English translation.
JP2009-39222—English translation.
JP2010-47885—English Translation.
JP5945050B1—English translation.
WO2016151969A—English translation.

* cited by examiner

SEWING APPARATUS

CROSS-REFERENCE TO RELATED APPLICATIONS

The present application claims the benefit of U.S. Provisional Application No. 63/266,203 filed Dec. 30, 2021, the contents of which are incorporated herein in their entireties.

FIELD OF THE INVENTION

The present invention relates to sewing machines and more particularly to a sewing apparatus for applying a stich of a thread to a piece of fabric, where the stitch may have the form of a chain stitch.

BACKGROUND OF THE INVENTION

Sewing machines utilizing a single spool of thread for making chain stitches through fabric are well known in the prior art.

Unlike conventional sewing machines, chain stitch machines require only one spool of thread, where the spool is usually positioned above the work platform of the machine. By contrast, conventional two-thread sewing machines require both a spool of thread positioned above the work platform, where the thread of this spool will be inserted through needle to co-act with needle driving through the fabric, and a second spool positioned below the sewing platform, to feed thread to the bobbin.

It is known in the art to provide chain stitch sewing machines with needles that actuate within a slider for driving a thread through a fabric resting on a work platform, where the work platform includes an aperture through which the thread is driven, and where a looping hook is operated beneath a work platform to take up a loop of the thread for forming a chain stitch pattern.

One of the challenges in operating chain stitch machines is in the removal and "tying-off" of the end of a stitch from the supply of thread housed in the sewing machine. As a chain stitch relies on the supply of a single, continuous length of thread that is connected through the needle and the sewing aperture, the stitch pattern can only be separated from the length of thread by cutting the thread where it is exposed, which is typically in the gap between the sewing aperture and the needle tip. In toy sewing devices for use by children, it is clearly undesirable to have a mechanism where children have to place their fingers or hands in close proximity to the needle or needle tip in order to finishing forming a stitch of thread. There is a need for a mechanism by which a user can remove and tie-off the end of a stitch from the supply of thread without having to put their hands close to the sewing aperture or needle tip.

SUMMARY OF THE INVENTION

According to an aspect, there is provided a sewing apparatus for applying a stitch of a thread to a piece of fabric, including a housing, a grasping member, a thread puller, a needle holder and a needle holder driver. The housing includes a platform with a sewing aperture. The platform is positioned for supporting the piece of fabric. The housing further includes an access aperture. The grasping member is movable between a grasping position in which the grasping member grasps a first thread segment below the sewing aperture, and a release position in which the grasping member releases the first thread segment about a second thread segment to form a segment of the stitch. The thread puller includes a securing feature and is movable from a first position in which the thread puller permits movement of the first thread segment within the housing below the sewing aperture, and a second position in which the thread puller drives the securing feature to pull the first thread segment through the access aperture to an exterior of the housing so as to permit a user to cut the first thread segment. The needle holder is positioned to hold a needle that has a needle aperture for pass-through, therethrough of the first thread segment. The needle holder is movable between a withdrawn position in which the needle holder holds the needle outside of the piece of fabric and an advanced position in which the needle holder drives the needle through the piece of fabric and through the sewing aperture to bring a second thread segment below the sewing aperture and into position for grasping by the grasping member. The needle holder driver is operatively connected to the needle holder to drive the needle holder to move between the withdrawn and advanced positions.

According to another aspect, there is provided a sewing apparatus for applying a stitch of a thread to a piece of fabric, including a housing, a grasping member, a needle holder, a needle holder driver, and a controller. The housing includes a platform with a sewing aperture. The platform is positioned for supporting the piece of fabric and includes a feed-in section on a first side of the sewing aperture. The housing further includes an access aperture. The grasping member is movable between a grasping position in which the grasping member grasps a first thread segment below the sewing aperture, and a release position in which the grasping member releases the first thread segment about a second thread segment to form a segment of the stitch. The needle holder is positioned to hold a needle that has a needle aperture for pass-through there through of the first thread segment. The needle holder is movable between a withdrawn position in which the needle holder holds the needle outside of the piece of fabric and an advanced position in which the needle holder drives the needle through the piece of fabric and through the sewing aperture to bring a second thread segment below the sewing aperture and into position for grasping by the grasping member. The needle holder driver is operatively connected to the needle holder to drive the needle holder to move between the withdrawn and advanced position. The fabric sensor is positioned to detect the presence of a portion of the piece of fabric on the platform feed-in section. The controller is connected to the fabric detection sensor and the needle holder driver, and is programmed such that when a portion of the piece of fabric is detected by the fabric detection sensor, the needle holder driver is engaged to move the needle holder between the withdrawn position and the advanced position. The controller is further programmed to stop the needle holder driver from driving the needle holder based at least in part on a detection of no fabric by the fabric detection sensor.

In some embodiments there is provided a sewing machine which provides a stitch in fabrics utilizing a single source of thread, and with a relatively small number of movable parts.

In some embodiments there is provided a sewing machine with an arrangement by which the thread that is being stitched to a piece of fabric by the sewing apparatus may be cut or separated from the single source of thread for securing of the end of the stitch in the fabric.

In some embodiments there is provided a sewing machine with an arrangement by which the thread is cut or separated from the single source of thread, where the arrangement enables the cutting of the thread to take place at a position distanced from the sharp needle tip.

In some embodiments there is provided a sewing machine that is controlled such that the electrical power powering the needle holder driver will only be shut-off once the needle is fully retracted within the housing of the sewing apparatus.

BRIEF DESCRIPTION OF THE DRAWINGS

Embodiments will now be described, by way of example only, with reference to the attached Figures, wherein.

DETAILED DESCRIPTION OF THE EMBODIMENTS

A sewing apparatus is provided for applying a stitch of a thread to a piece of fabric. In an embodiment, the sewing apparatus utilizes a single spool of thread. In an embodiment, the sewing apparatus is configured to apply a chain stitch pattern of the thread to the piece of fabric.

Figure 1A:
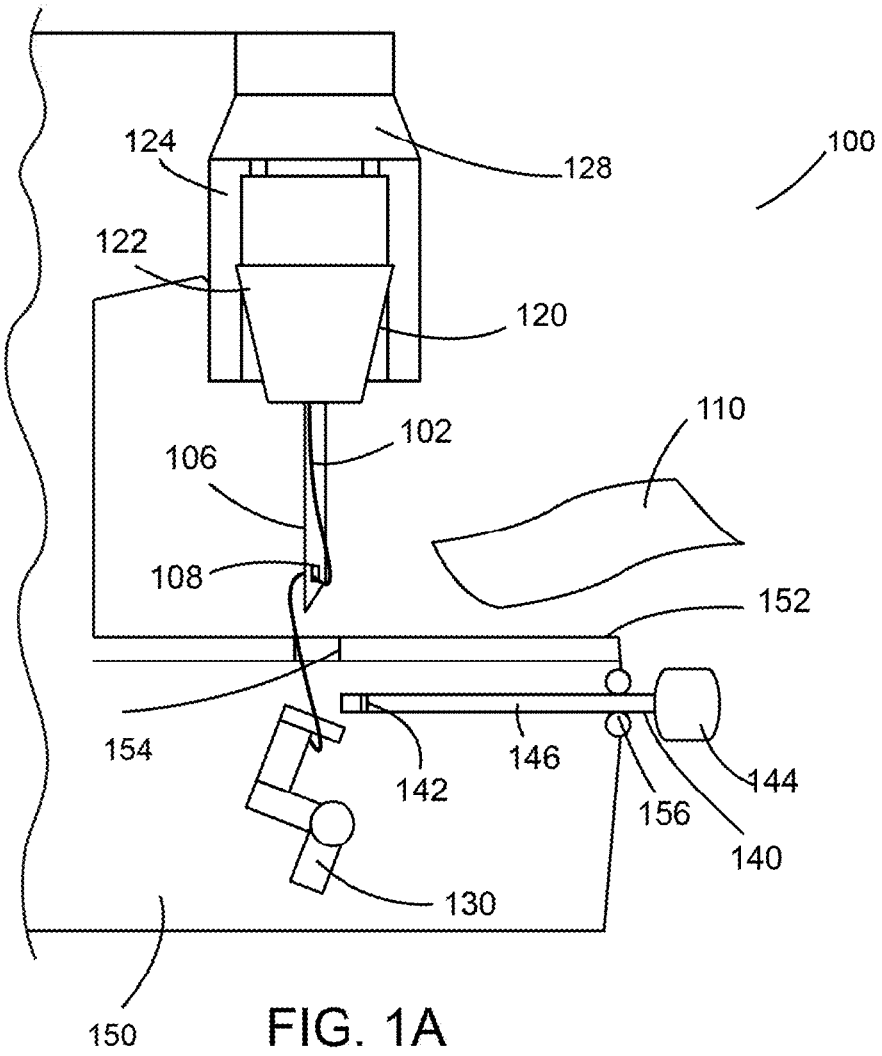
FIG. 1A shows a schematic of the sewing apparatus with the needle holder in a withdrawn position.
Figure 1B:
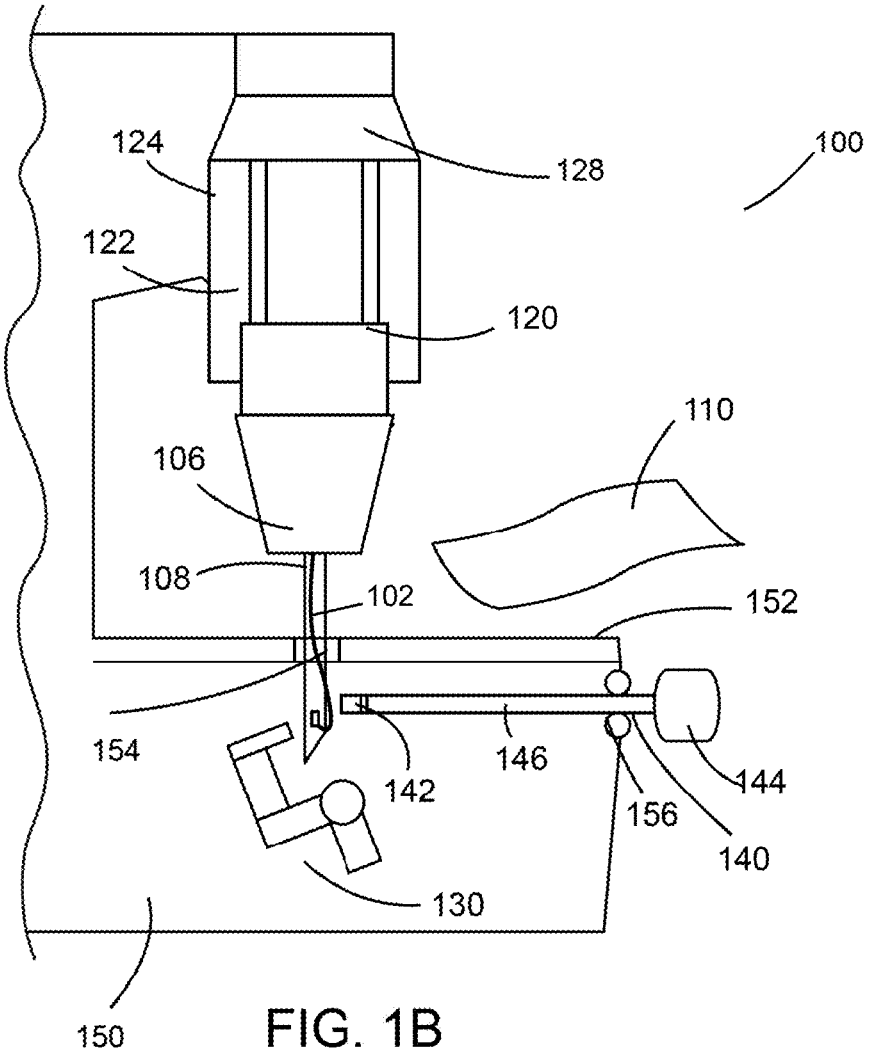
FIG. 1B shows a schematic of the sewing apparatus with the needle holder in an advanced position.

Referring to the schematic views of FIGS. 1A and 1B, a first embodiment of the sewing apparatus 100 for applying a stitch of a thread to a piece of fabric 110 is shown. In this embodiment, the sewing apparatus 100 includes a housing 150 with a platform 152 and an access aperture 156, a grasping member 130, a thread puller 140, a needle holder 120 and a needle holder driver 124. The piece of fabric is shown at 110. The thread is shown at 102.

In an embodiment, the stitch in the piece of fabric 100 is a chain stitch and requires only one supply of thread that is positioned above the grasping member 130 to supply the mechanism with thread 102 for forming the chain stitch.

As shown in FIGS. 1A and 1B, the housing 150 of the sewing apparatus 100 includes a platform 152 with a sewing aperture 154. The platform 152 is positioned to support the piece of fabric 110 to which the stitch of the thread 102 is to be applied. The needle holder driver 120 is generally positioned above the sewing platform 152 so as to align a needle 106 held in the needle holder 120 with the sewing aperture 154.

Figure 3A:
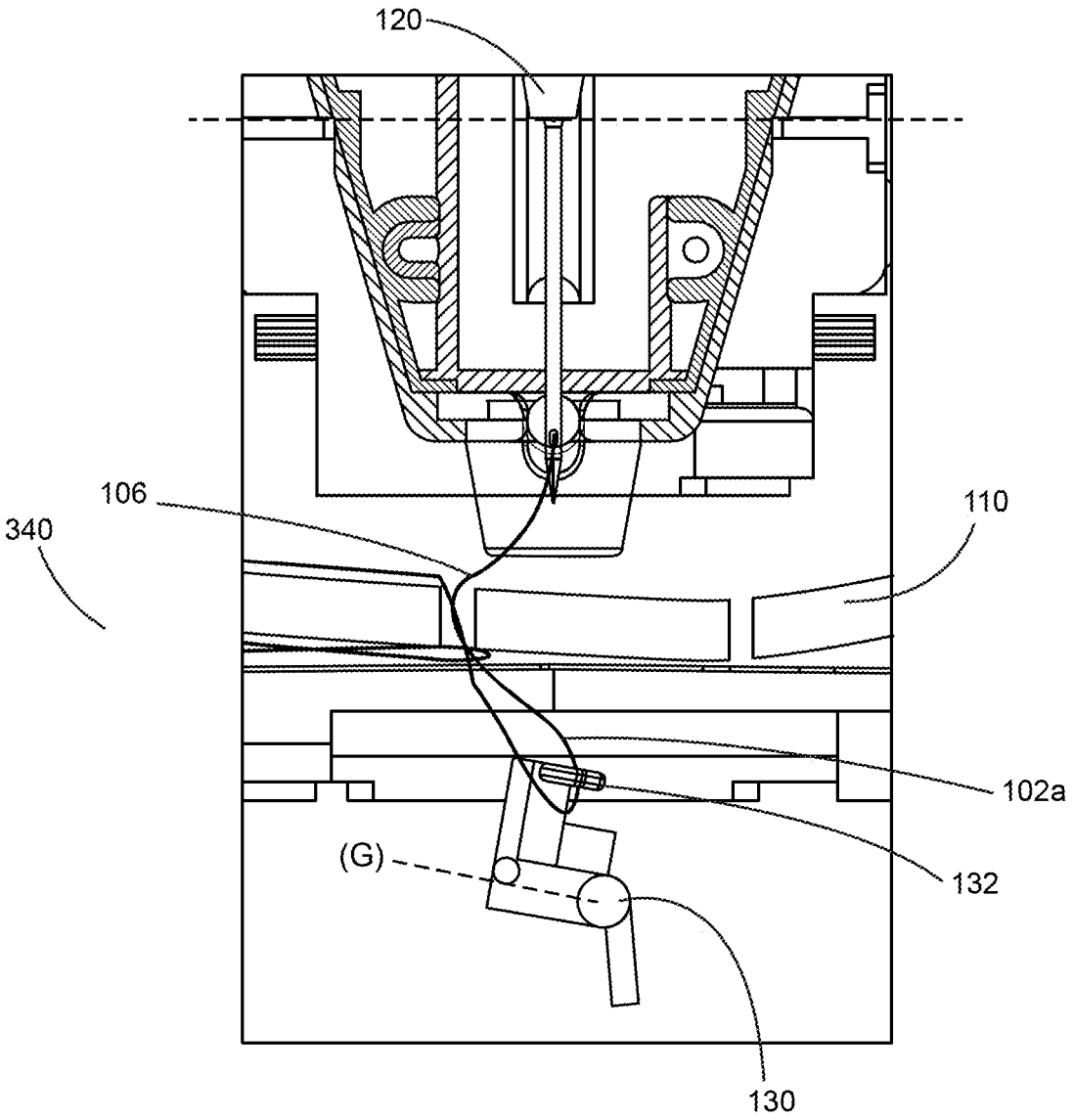
FIG. 3A shows a front view of the sewing apparatus in a state with the needle holder and the needle in a withdrawn position and a grasping member in a grasping position.
Figure 3C:
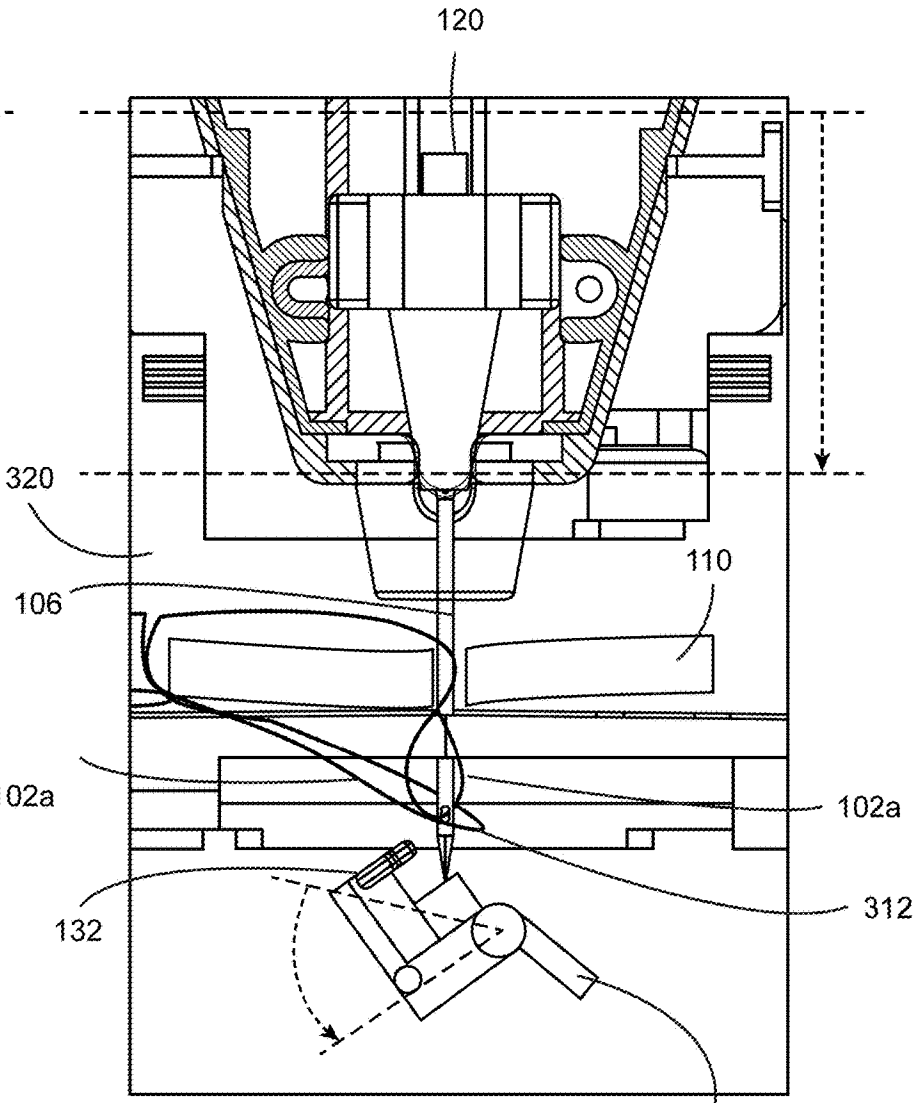
FIG. 3C shows a front view of the sewing apparatus in a state with a needle holder and needle in the advanced position and the grasping member in the release position.
Figure 3B:
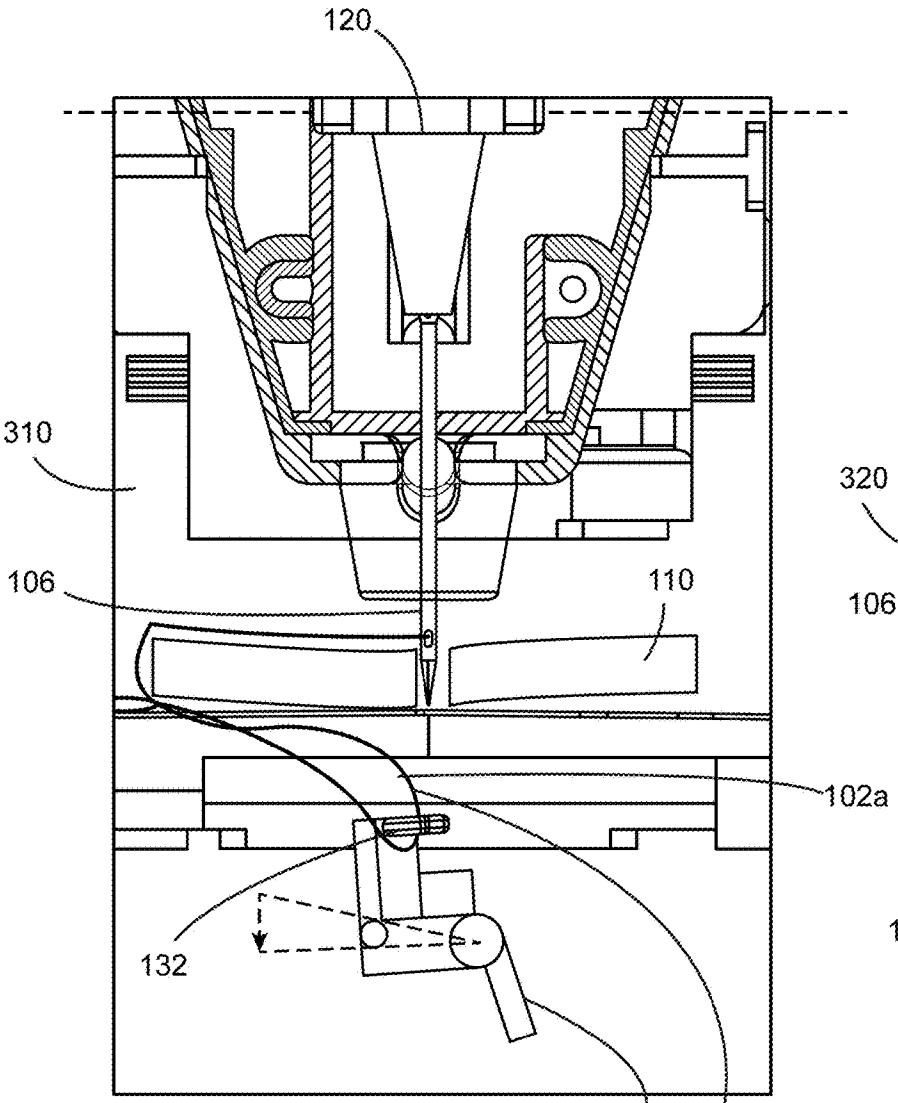
FIG. 3B shows a front view of the sewing apparatus in a state with the needle holder and the needle having moved partway towards an advanced position and the grasping member having moved partway towards a release position.

The needle holder 120 is formed to support the sewing needle 106 and to guide the needle 106 through a reciprocating motion to apply a stitch to the piece of fabric 110. A needle holder driver 128 is operatively connected to the needle holder 120 to drive the needle holder 120 to move between a withdrawn position (FIG. 3D) and an advanced position (FIG. 3B).

In an embodiment, the needle 106 is securely fixed within an aperture formed at the bottom of the needle holder 120, and is a conventional sewing needle having a needle aperture 108 for passage therethrough of the first thread segment 102. As shown in FIGS. 1A and 1B, the needle holder 120 is positioned to hold the needle 106. The first thread segment is generally looped around the needle aperture 108 of the needle 106.

The needle holder 120 is movable between a withdrawn position (shown in FIG. 1A) in which the needle holder 120 holds the needle 106 outside of the piece of fabric and an advanced position (shown in FIG. 1B) in which the needle holder 120 drives the needle 106 through the piece of fabric and through the sewing aperture 154 to bring a second thread segment below the sewing aperture 154 and into position for grasping by the grasping member 130. The needle holder 120 also holds the needle 106 as the needle 106 is withdrawn from the piece of fabric 110.

The needle holder 120 includes a stationary portion 124 and a movable portion 122. In the embodiment shown in FIG. 1B, the movable portion 122 is a slidable member that is held in sliding relation to the stationary portion 124 via at least one suitable guiding surface.

In an embodiment, the needle holder 120 includes transverse bars which are shaped to abut parallel sidewalls of the housing 150 (not shown) to constrain the vertical movement of the needle holder 120 so as to not exceed a predetermined distance, where this distance is defined as the distance between the withdrawn and advanced positions of the needle holder 120.

Figure 2:
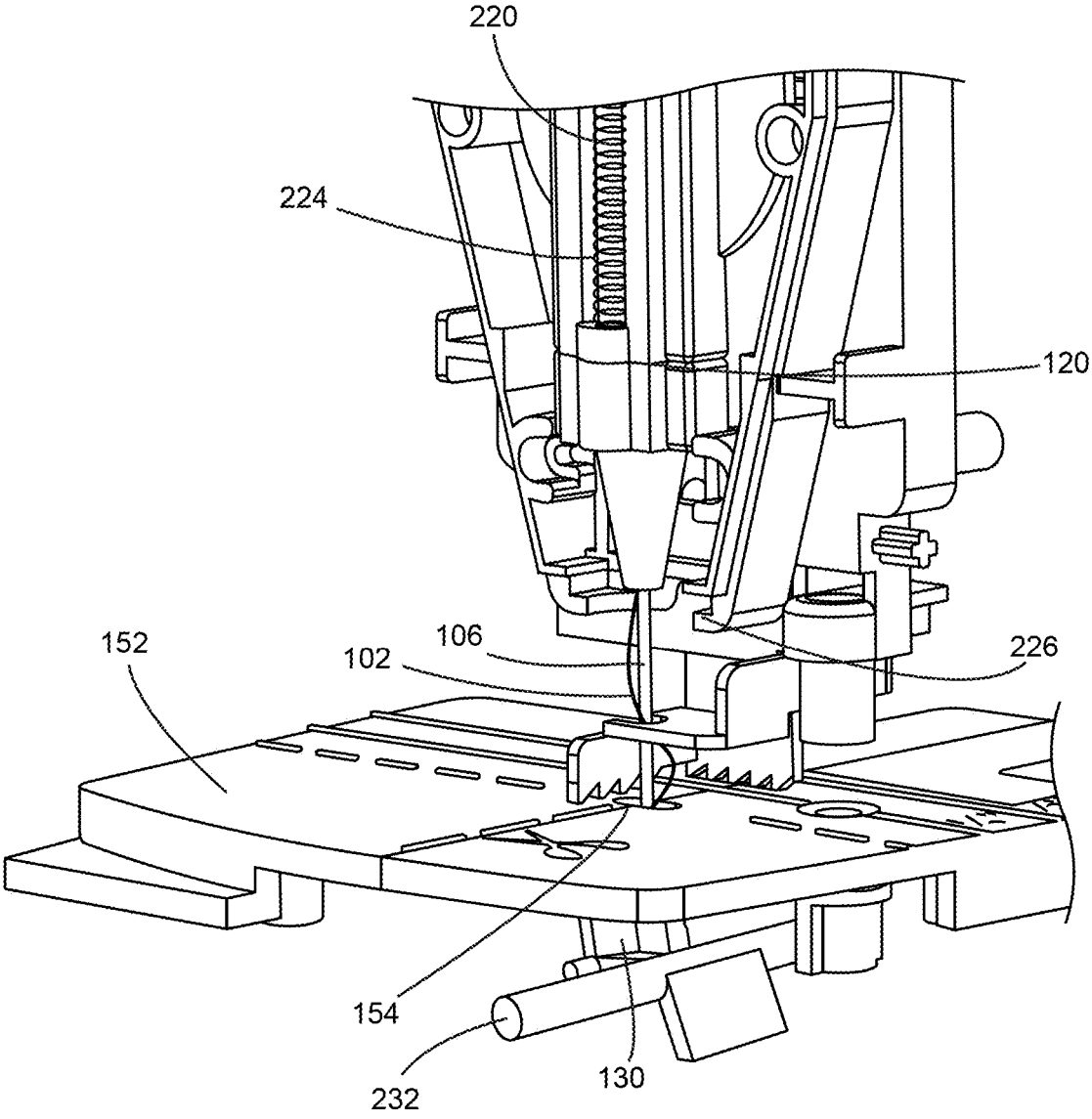
FIG. 2 shows a projected view of an embodiment of the sewing apparatus.

In an additional embodiment shown in FIG. 2, the needle holder 120 includes a biasing member connected to bias the needle holder 120 towards the withdrawn position. In the specific example provided in FIG. 2, the biasing member can be a wire spring member 220 that vertically extends between the housing 150 and a top portion of the needle holder 120. In the exemplary wire spring member shown, the spring is seated within a channel 224 of the needle holder 120 and a free end of the spring 220 engages a bottom portion of the channel 224 of the needle holder 120 to thereby bias needle holder 120 towards the withdrawn position.

As shown in FIGS. 1A and 1B the grasping member 130 is positioned below the sewing platform 152, beneath the sewing aperture 154 such that the grasping member 130 can take-up and retain the first thread segment that is fed through the sewing aperture 154 by the needle 106 (as the needle holder moves into the advanced position).

Referring to FIGS. 1A and 1B, the grasping member 130 is movable between a grasping position (shown in FIG. 1A) in which the grasping member 130 can grasp a first thread segment below the sewing aperture 154 and a release position (shown in FIG. 1B). When the grasping member 130 is in the grasping position and is grasping the loop of first thread segment to form a loop, the grasping member 130 is then be driven to release the loop of the first thread segment. As the grasping member 130 moves towards the release position, the hooking projection of the grasping member 130 spreads and releases the loop of the first thread segment for the subsequent insertion of the needle carrying a second thread segment. In this way, the grasping member 130 releases the first thread segment about a second thread segment to form a segment of the stitch. More details regarding the function of the grasping member 130 in forming the chain stitch are provided blow.

In one embodiment, the grasping member 130 is a looping hook that reciprocates between the grasping position and the release position, such that the stitch that is formed in the piece of fabric is a chain stitch. The looping hook has a generally inverted, L-shaped configuration with a hook end thereof configured to form a hooked point extending generally parallel to the sewing platform.

In the embodiment provided in FIGS. 1A-1B, 2 and 3A-3D, the grasping member 130 is a continuous body, and includes a hooking projection 132 on a top portion thereof. Referring to FIG. 2, the grasping member is mounted to a shaft portion 232, where the shaft portion 232 may be pivotally engaged with apertures provided in the housing 150, below the sewing platform 152. In an embodiment, the motion of the grasping member 130 is coupled to motion of needle holder 120 such that the motion of the grasping member 130 between the grasping and release positions is also driven by the needle holder driver. The needle holder driver may be connected to the shaft portion 232 to drive the motion of the grasping member 130 between the release and grasping positions.

The grasping member 130 may include a biasing member connected thereto to bias the grasping member 130 towards the release position. In the embodiments where the grasping member 130 is mounted on a shaft portion 232, the biasing element is a coil biasing spring encircling at least a section of shaft portion 232. In the specific example shown in FIGS. 1A-1B, 2 and 3A-3D, the grasping member 130 is biased in a counterclockwise direction when it is in the release position.

Referring to FIGS. 3A, 3B, 3C, 3D and 3E, the combined operation of the grasping member 130 and the needle holder 120 in forming a stitch of the chain stitch. In this embodiment, the sewing apparatus generates a chain stitch pattern of the thread in the piece of fabric. The movements of the needle holder 120 and the grasping member 130 are coupled to one another for forming the chain stitch pattern.

Figure 3E:
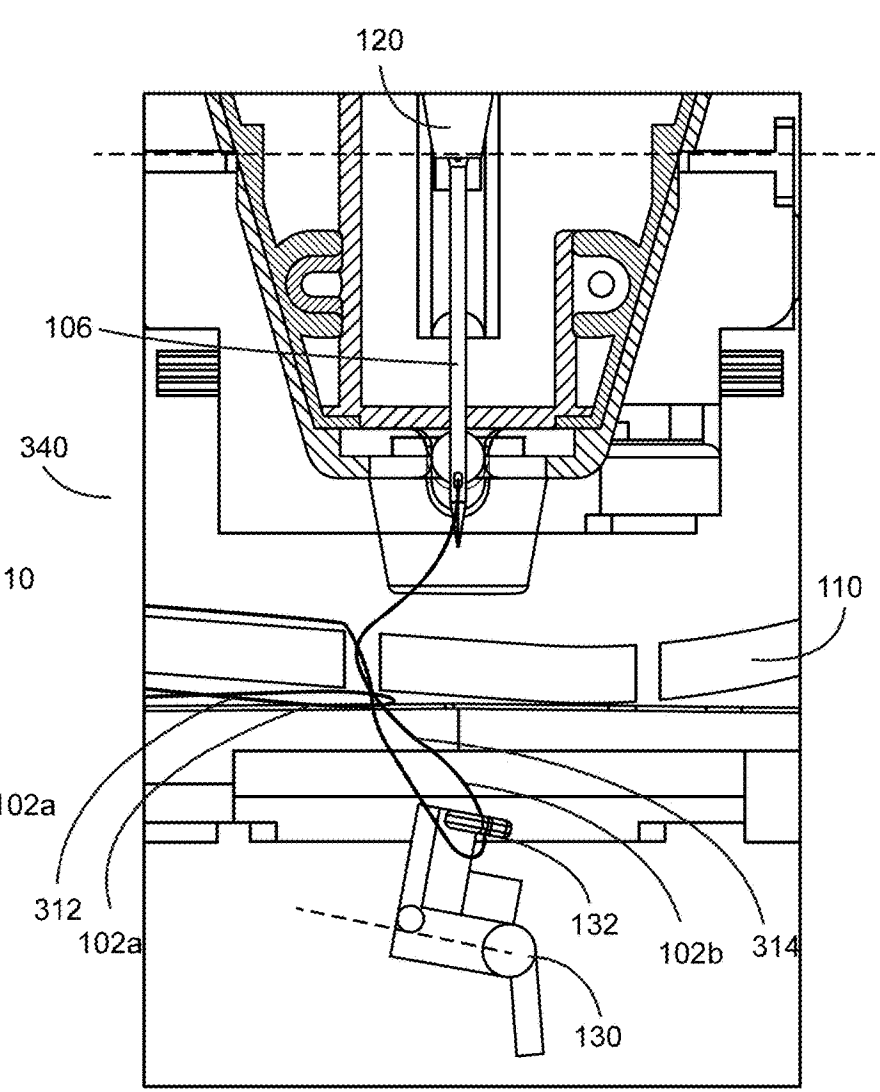
FIG. 3E shows a front view of the sewing apparatus in a state with the needle holder and the needle in the withdrawn position again and a grasping member in the grasping position again.
Figure 3D:
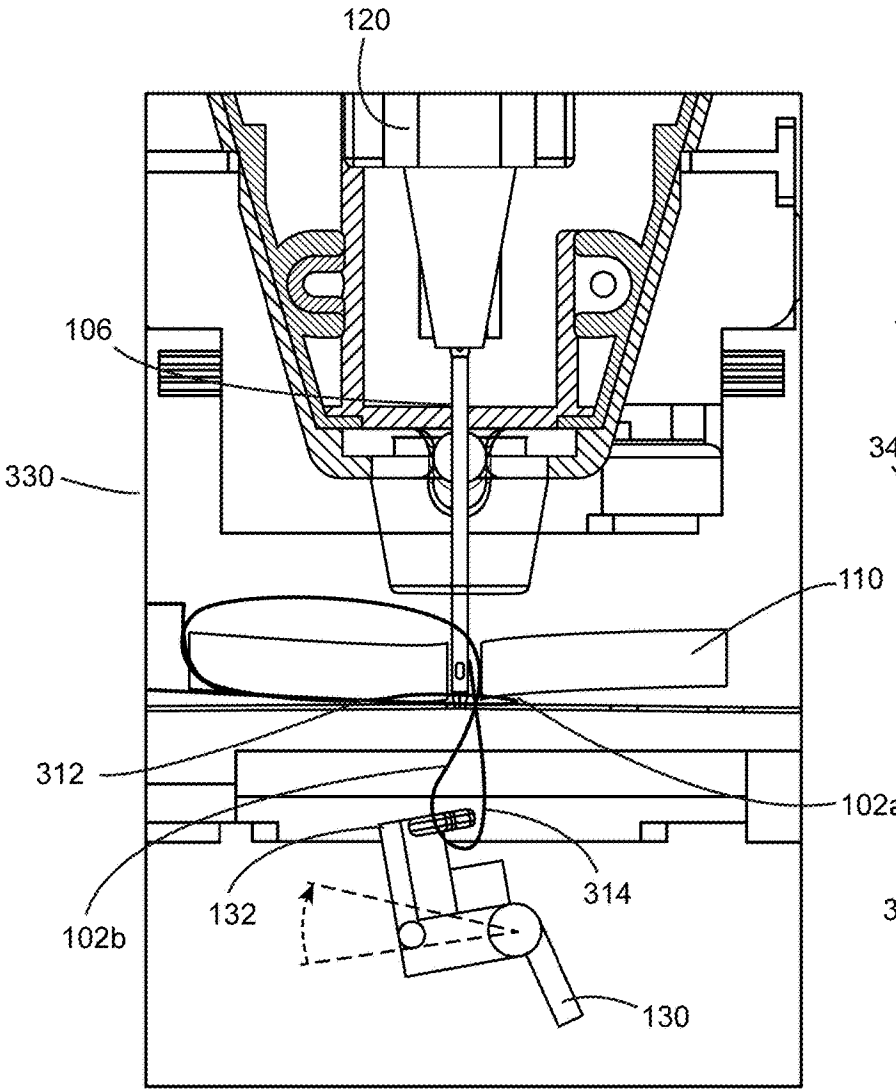
FIG. 3D shows a front view of the sewing apparatus in a state with the needle holder and the needle having moved partway towards the withdrawn position and the grasping member having moved partway towards the grasping position.
Figure 4:
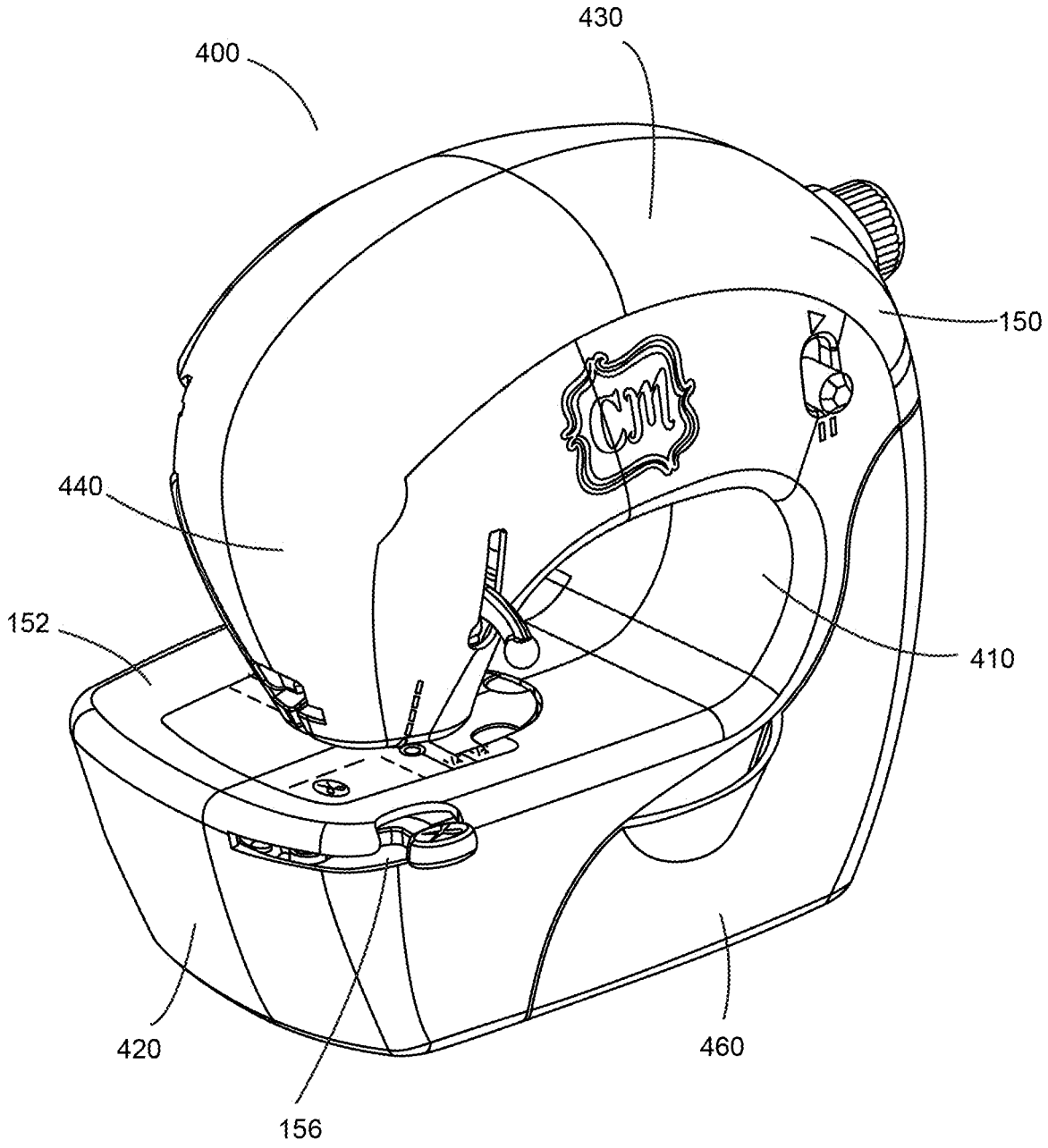
FIG. 4 shows an embodiment of sewing apparatus enclosed within the housing.

In this embodiment, the needle holder 120 with the needle 106 therein commences its downward travel from a withdrawn position. FIG. 3A shows the needle holder 120 and the needle 106 in the withdrawn position, and the grasping member 130 in the grasping position, in which the grasping member 130 grasps the first thread segment 102*a* and forms a loop 312 therewith. FIG. 3B shows the needle holder 120 and needle 106 having moved partway towards the advanced position. As the needle holder 120 moves from the withdrawn position and towards the advanced position, the needle 106 is moved to penetrate through the piece of fabric 110 to feed at least the second thread segment 102*b* through the piece of fabric 110. At the same time, the grasping member 130 moves from the grasping position towards the release position. As shown in FIG. 3C, the needle 106 and the second thread segment 102*b* pass through the sewing aperture 152 and the needle 106 passes the second thread segment 102*b* through the loop 312 formed from the first thread segment 102*a*, by the grasping member 130. In the position shown in FIG. 3C, the needle holder 120, and therefore the needle 106 may be in the advanced position. Additionally, in the position shown in FIG. 3C, the grasping member 130 may be in the release position, so as to release the first thread segment 102*a* about the second thread segment 102*b*, which, when tightened about the second thread segment 102*b*, forms a segment of the stitch. FIG. 3D shows the needle holder 120 and the needle 106 moving back towards the withdrawn position, and the grasping member 130 moving from the release position towards the grasping position. During this movement, the grasping member 130 engages (e.g. hooks) a second loop 314 formed by the second thread segment 102*b*, via the hooking projection 132 of the grasping member 130. Once the needle 106 has been withdrawn from the piece of fabric 110, the sewing apparatus 100 employs a fabric advancement device 600 to advance the piece of fabric 110, thereby pulling the first loop 312 tight about the second loop 314, as shown in FIG. 3E.

Once the fabric is advanced, the sequence of steps shown in FIGS. 3B-3E may be repeated to form a sequences of stitches on the piece of fabric.

It will be noted that the grasping member 130 does not need to reach the grasping position at precisely the same time that the needle holder 120 and the needle 106 reach the advanced position or for the grasping member 130 to reach the release position at precisely the same time that the needle holder 120 and the needle 106 reach the withdrawn position.

It will further be noted that the steps outlined above for forming a chain stitch would be understood by one skilled in the art and any other suitable structure for providing a chain stitch may be used.

Figure 11B:
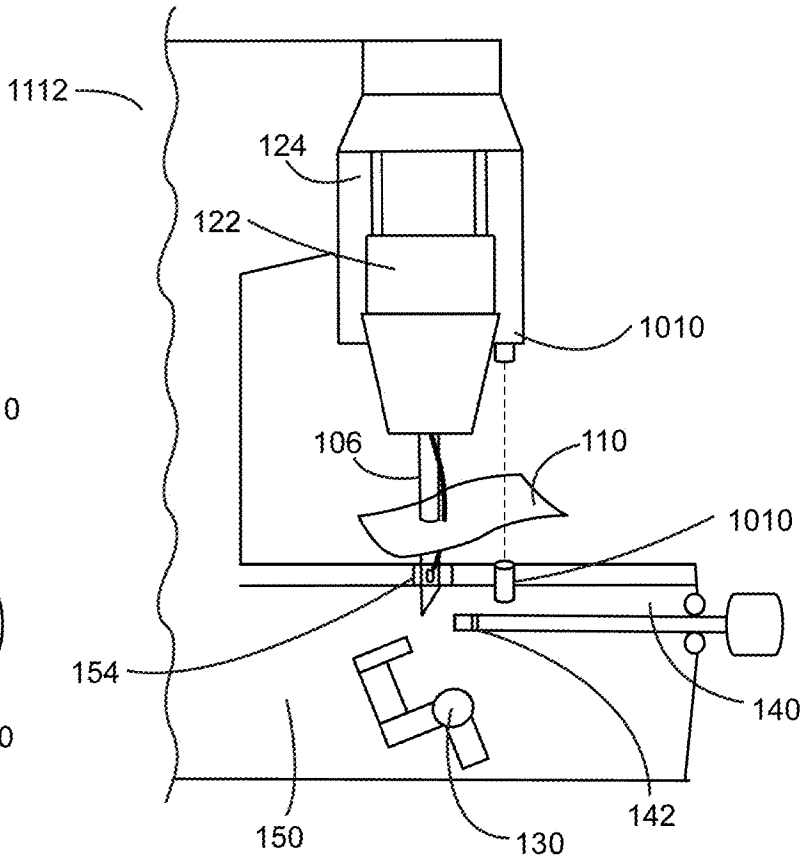
FIGS. 11A and 11B are side elevation views of the sewing apparatus with the needle holder being controlled to move between withdrawn and advanced positions due to the fabric detection sensor.

As shown in FIGS. 1A and 11B, the sewing machine 100 optionally includes a thread puller 140. The thread puller 140 is mounted in the housing 150 to actuate through the access aperture 156. The thread puller 140 movable from a first position in which the thread puller permits movement of the first thread segment 102*a* within the housing 150 below the sewing aperture 154 (where this movement may include the first thread segment 102*a* being taken up as a loop by the grasping member 130, or being released by the grabbing member 130), and a second position in which the thread puller 140 drives a securing feature 142 (that is included with the thread puller 140) to pull the first thread segment 102*a* through the access aperture 156 to an exterior of the housing 150, so as to permit a user to cut the first thread segment 102*a*. The access aperture 156 is generally sized to permit the movement of at least part of a thread puller 140 therethrough. As shown in FIG. 1A, the thread puller is mounted in the base of the housing 150, below the sewing platform 152, where the thread puller 140 is mounted proximate the access aperture 156, such that the at least part of the thread puller 140 can actuate through the access aperture 156 when the thread puller 140 moves between the first and second positions. The thread puller 140 can include a handle portion 144 on a first end thereof, and a connecting arm 146 that connects the securing feature 142 and the handle portion 144 of the thread puller 140.

In an embodiment, the thread puller 140 is operated to move from the first position to the second position when the needle 106 and needle holder 120 are moving or have moved back to the withdrawn position, and while the loop of the first thread segment 102*a* is still being retained by the grasping member 130. In this embodiment, the movement of the thread puller 140 from the first position to the second position causes the securing feature 142 of the thread puller to remove the loop of the first thread segment 102*a* from the grasping member 130 and to pull the at least the first thread segment 102*a* through the access aperture 156.

The thread puller 140 can be used to close off the stitch of thread 102 when the stitch reaches the end of the piece of fabric 110. In an embodiment, the driving of movement of the needle holder 120 by the needle holder driver is stopped when the stitch pattern reaches the end of the piece of fabric 110. The thread puller 140 is then moved from the first position to the second position, and the first thread segment 102*a* is pulled through the access aperture 156 to the exterior of the housing 150, where a user can cut and optionally tie the thread to secure the stitch pattern at the end of the piece of fabric 110.

Figure 7A:
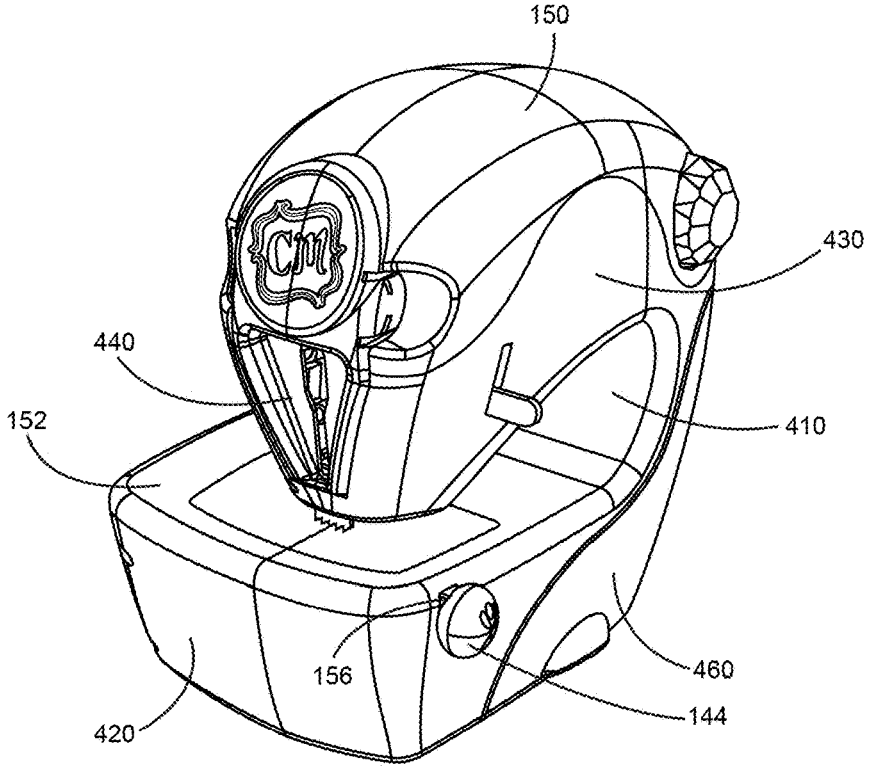
FIG. 7A shows an isometric view of a slidable embodiment of the thread puller in the release position.
Figure 7B:
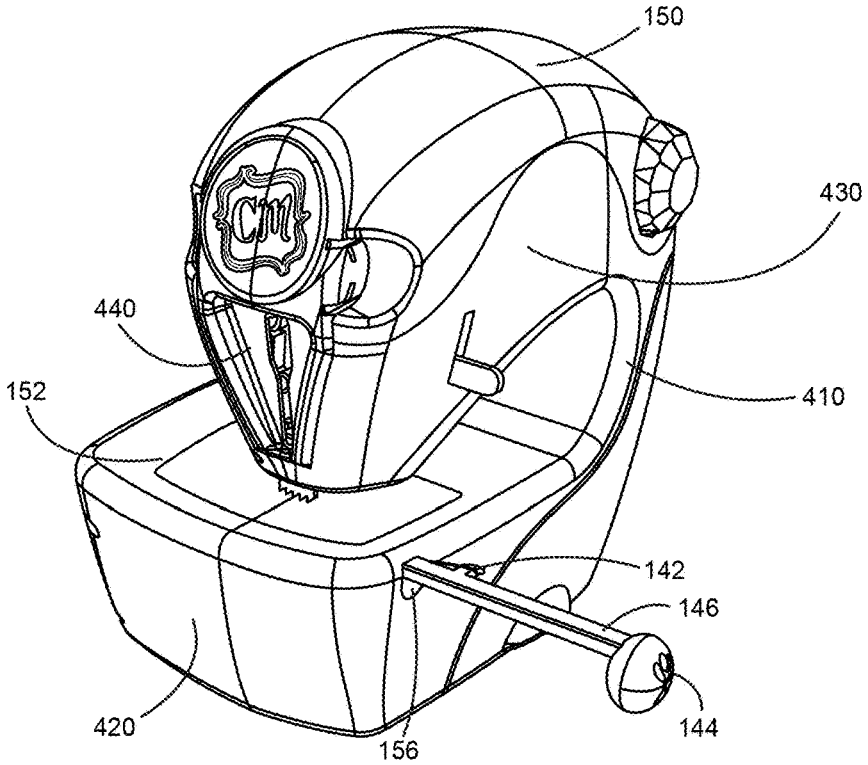
FIG. 7B shows an isometric view of a slidable embodiment of the thread puller in the grasping position.
Figure 7C:
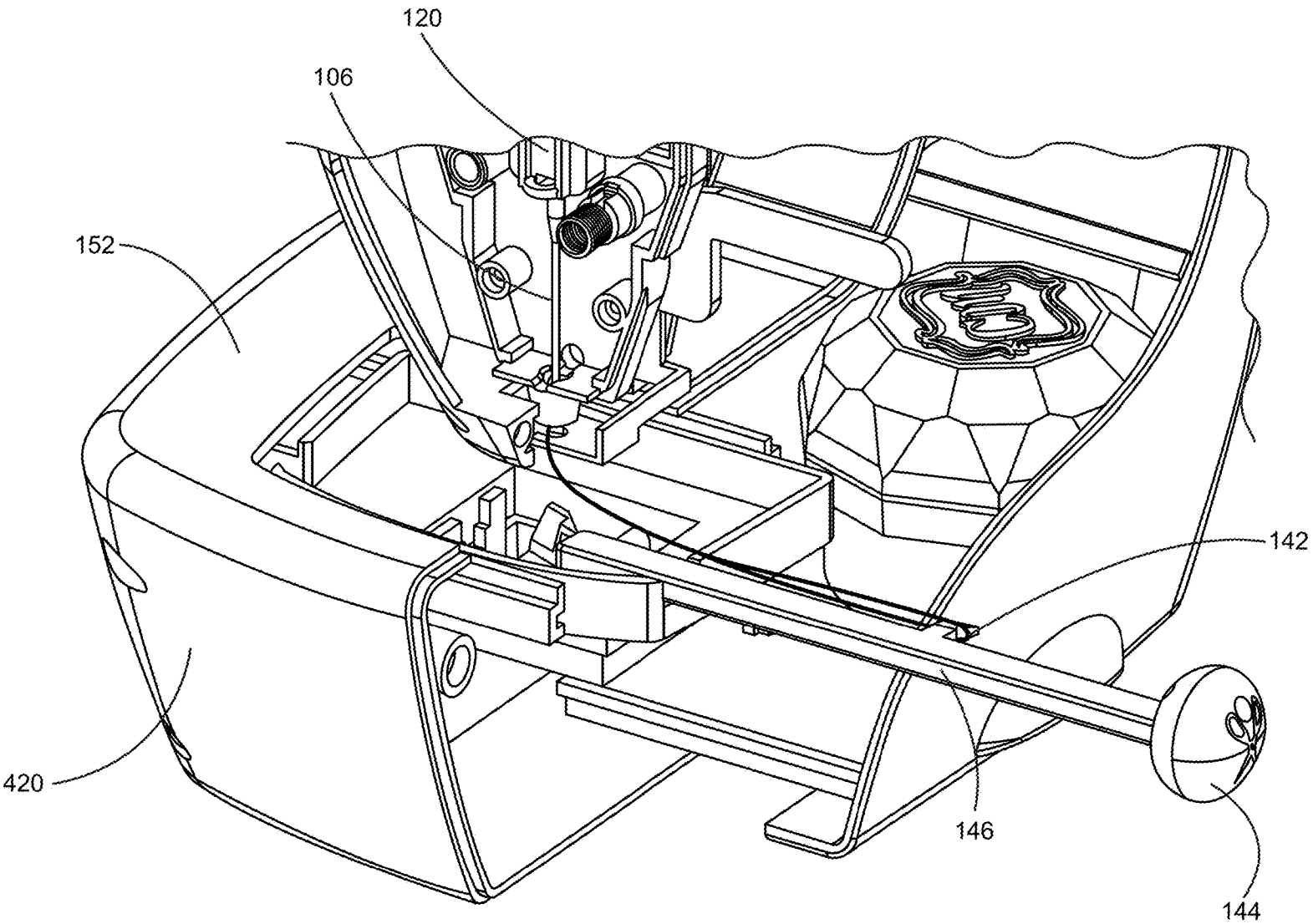
FIG. 7C shows a cut-out view of a slidable embodiment of the thread puller in the grasping position.

In an embodiment, the thread puller 140 is formed to be slidable, relative to the housing 150, between the first and second positions. In a specific example of this embodiment shown in FIG. 7A-7C, the access aperture 156 has a rectangular shape, and the thread puller 140 includes a connecting arm 146 with a rectangular cross section, and a handle portion 144 on an end thereof for holding by a user. As shown in FIG. 7C, the securing feature 142 of the member 140 is a hook positioned on a vertical side-wall of the connecting arm 146 for grasping and pulling the first thread segment 102*a*. The thread puller is formed to pull the first thread segment 102*a* from a first position (shown in FIG. 7A) to a second position (shown in FIG. 7B) where the first thread segment 102*a* is exposed, exterior to the housing 150.

Figure 6A:
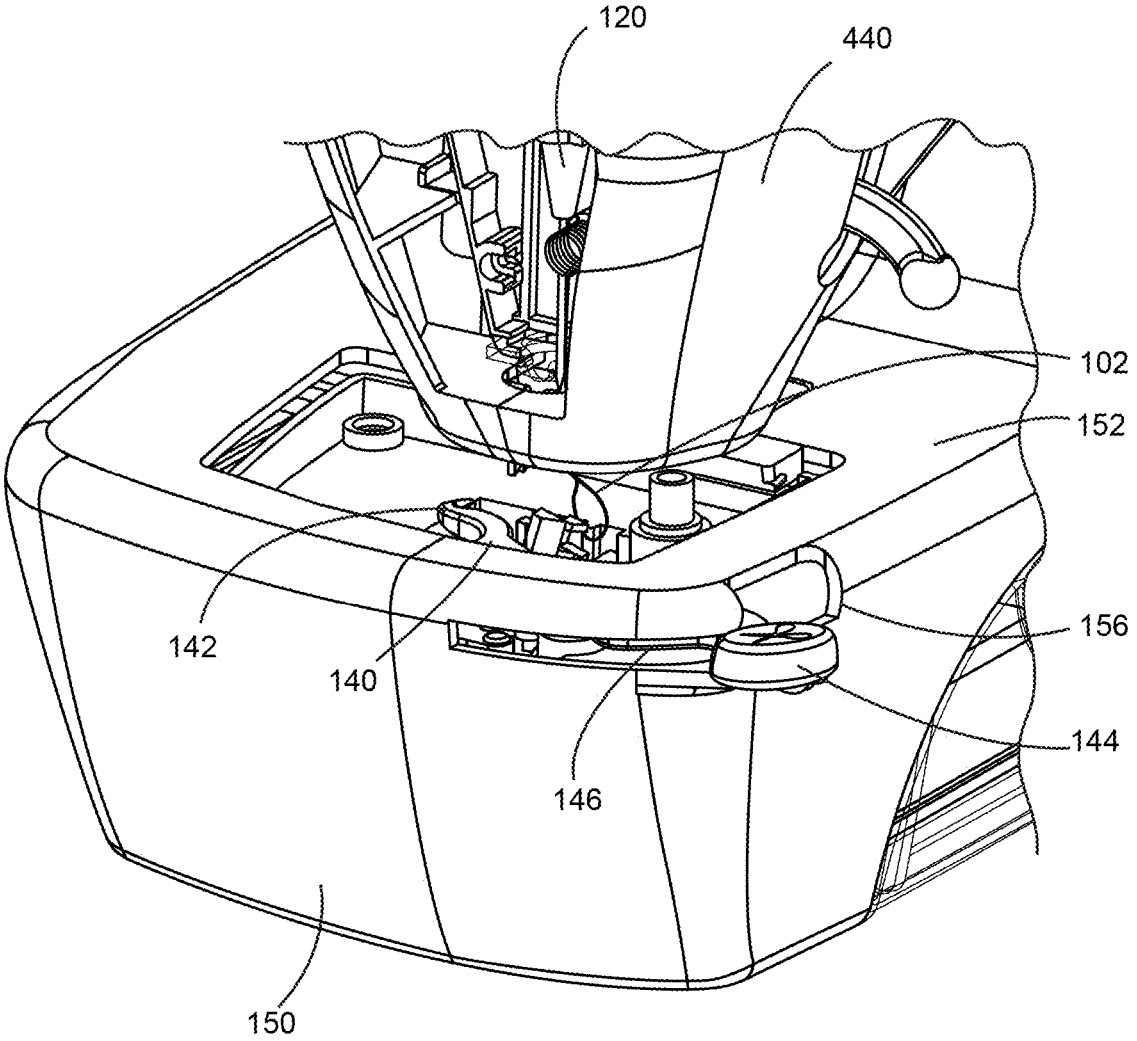
FIG. 6A shows a pivotable embodiment of the thread puller enclosed within the housing of the sewing apparatus.
Figure 6B:
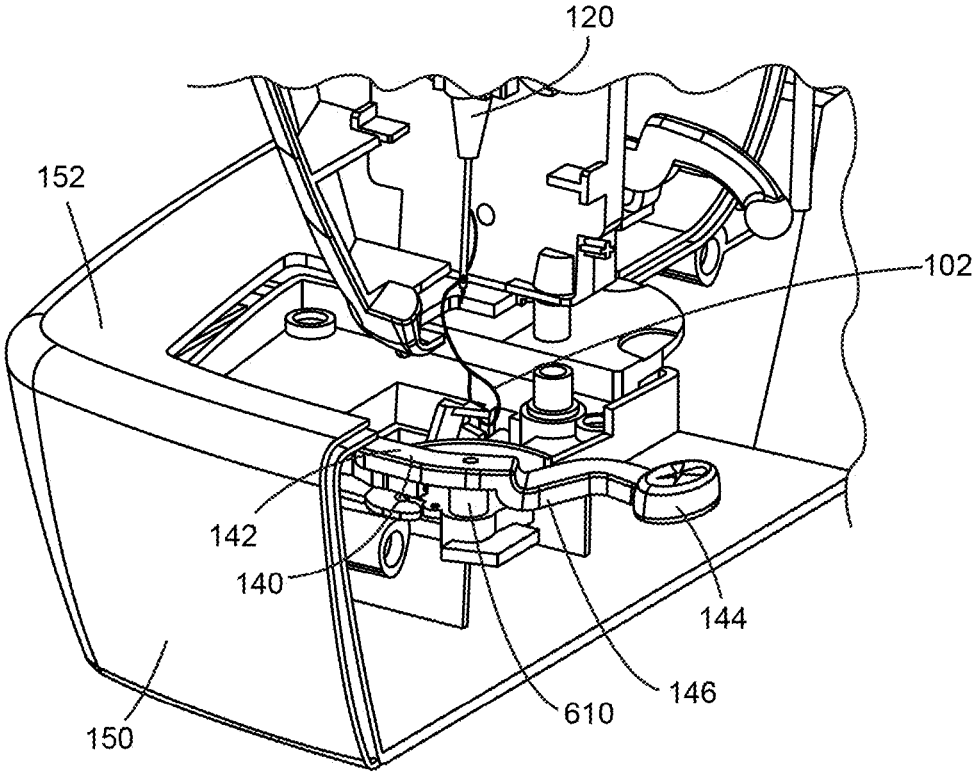
FIG. 6B shows a cut-out view of a pivotable embodiment of the thread puller in the release position.
Figure 6C:
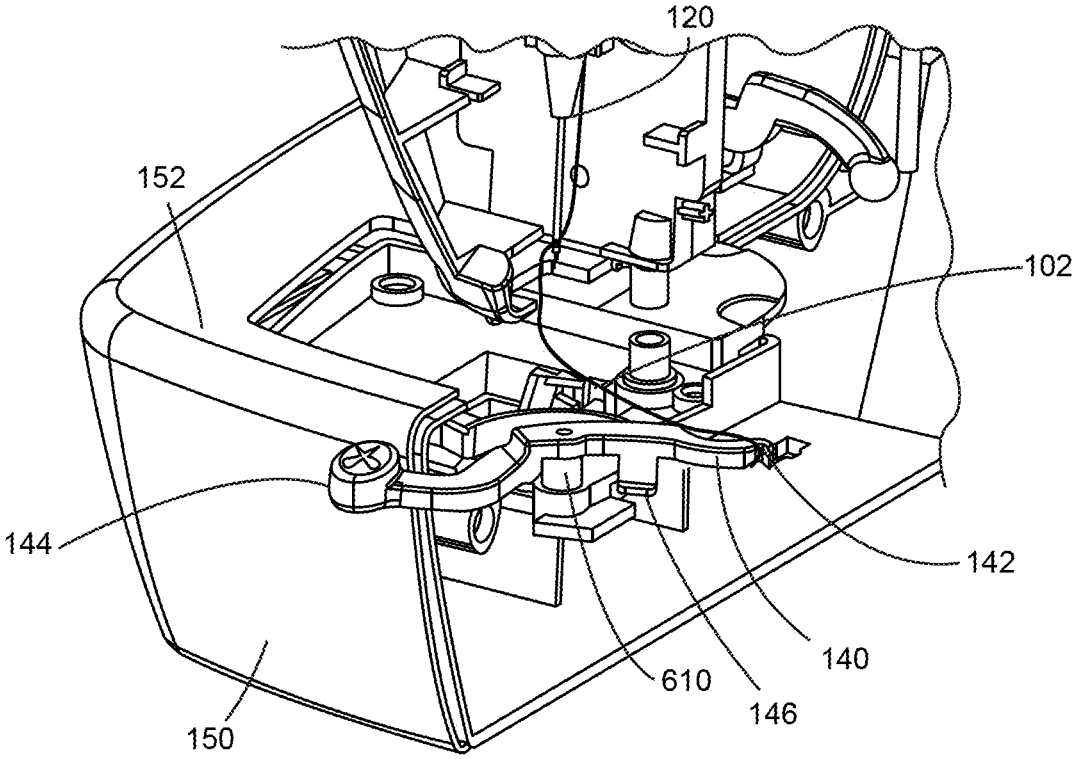
FIG. 6C shows a cut-out view of a pivotable embodiment of the thread puller in the grasping position.
Figure 6D:
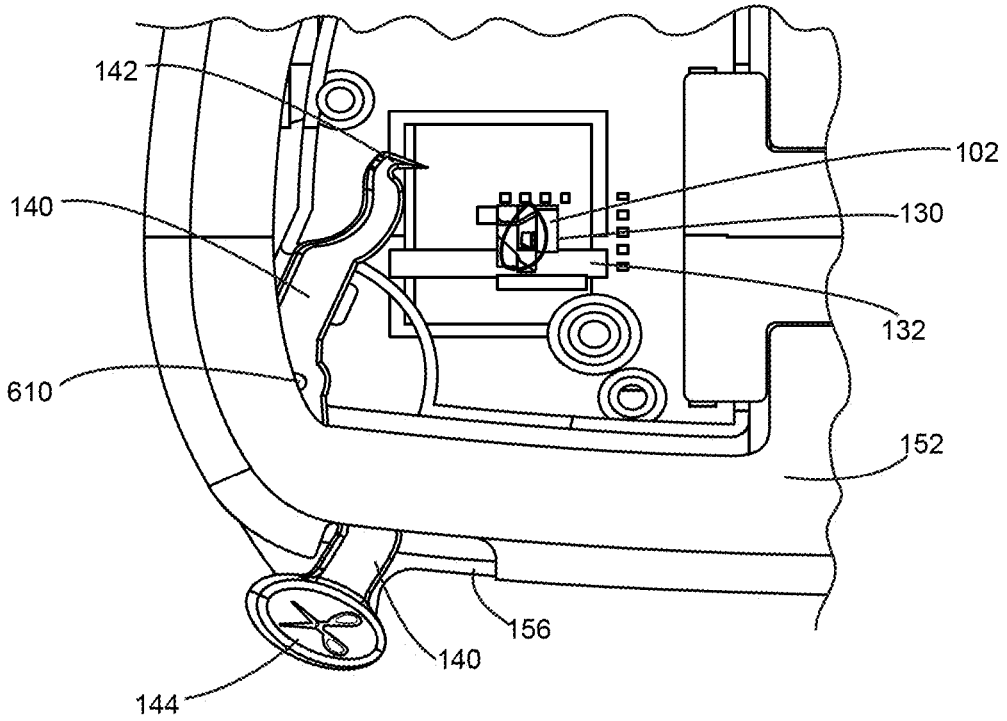
FIG. 6D shows a top view of a pivotable embodiment of the thread puller in the release position.
Figure 6E:
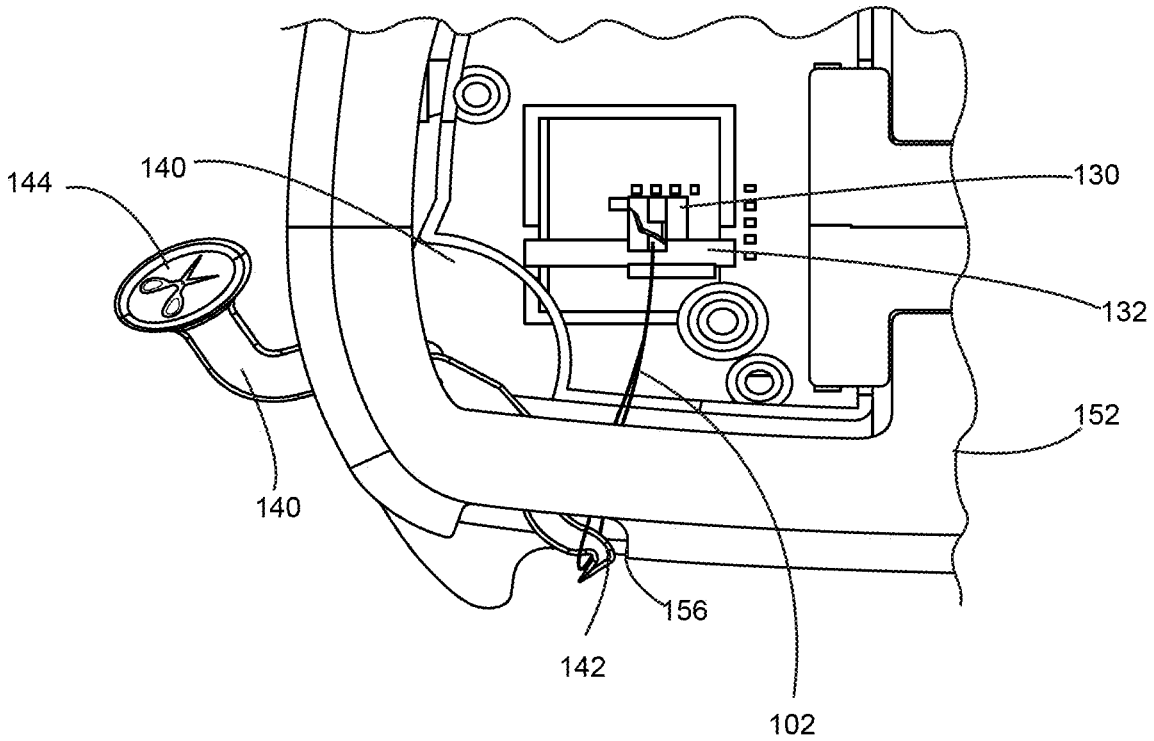
FIG. 6E shows a top view of a pivotable embodiment of the thread puller in the grasping position.

In the alternative embodiment, the thread puller 140 is formed to be pivotable about the housing 150 between the first position (shown in FIGS. 6B and 6D) and the second position (shown in FIGS. 6C and 6E). In the specific example shown in FIG. 6A-6E, the thread puller includes an connecting arm 146 with a pivoting connection 610 positioned on a middle section thereof. The arm 146 includes a gripping member 144 on an external end thereof, and a securing feature 142 in the form of a hook 620 on the other end thereof. The pivoting connection 610 is mounted to the housing below the platform 152 for pivoting of the thread puller thereabout.

In an additional embodiment, the housing 150 includes a detent to releasably hold the thread puller 140 in the second position. Further details as to the structure of the housing are provided below.

In an embodiment, the sewing apparatus 100 further comprises a tensioning element positioned to apply tension to the first thread segment 102*a* between a thread spool positioned within the housing, and the needle 106 to limit an unwinding of thread 102 from the spool when the securing end 142 of the thread puller 140 moves to the second position and pulls the first thread segment 102*a*.

The housing of the sewing aperture 100 can be a closed-off housing 150 which contains all the other elements of the sewing apparatus (e.g. the needle holder 120, needle holder driver, grasping member 130). Referring to FIG. 2A, an embodiment of the sewing apparatus 400 where the sewing mechanism is fully enclosed within the housing is provided. In this embodiment, the housing 150 includes a column 410 extending vertically from the sewing platform 152. The column 410 extends upwards from a rear portion of a base unit 420 of the housing, where the sewing platform 152 is integrally formed on a top surface of the base unit 420. The column 410 includes a curvature that extends upwards and outward in the direction of the sewing aperture 154 on the sewing platform 152. The housing can further include a support arm 430 that extends out from the column 410 in a direction overtop the sewing aperture 154. In the displayed embodiment, the support arm 430 extends out from the column 410 and terminates in a head element 440, where the head element 440 is positioned overtop the sewing aperture, and the head element 440 extends downward from the support arm towards the sewing aperture. In this embodiment, the sewing platform, column, support arm and head element 440 are all formed to be substantially hollow for housing at least some of the needle holder, grasping member 130, needle holder driver and thread puller.

Referring to FIGS. 2B and 2C an embodiment of the sewing assembly within the housing of FIG. 2A is provided. In the specific embodiment presented in FIG. 2C, needle holder is positioned within the head element 440 of the support arm 430 of the housing 150. In this embodiment, the head element 440 of the support arm 430 includes a central aperture on a bottom surface of the head element 440 through which the needle 106 passes upon reciprocal movement of needle holder 120 between the withdrawn and advanced positions. The needle holder 120 operates to move the needle 106 on a given line to pass it downwardly from the withdrawn position, through this central aperture and through the sewing aperture 154, to the advanced position.

Figure 5:
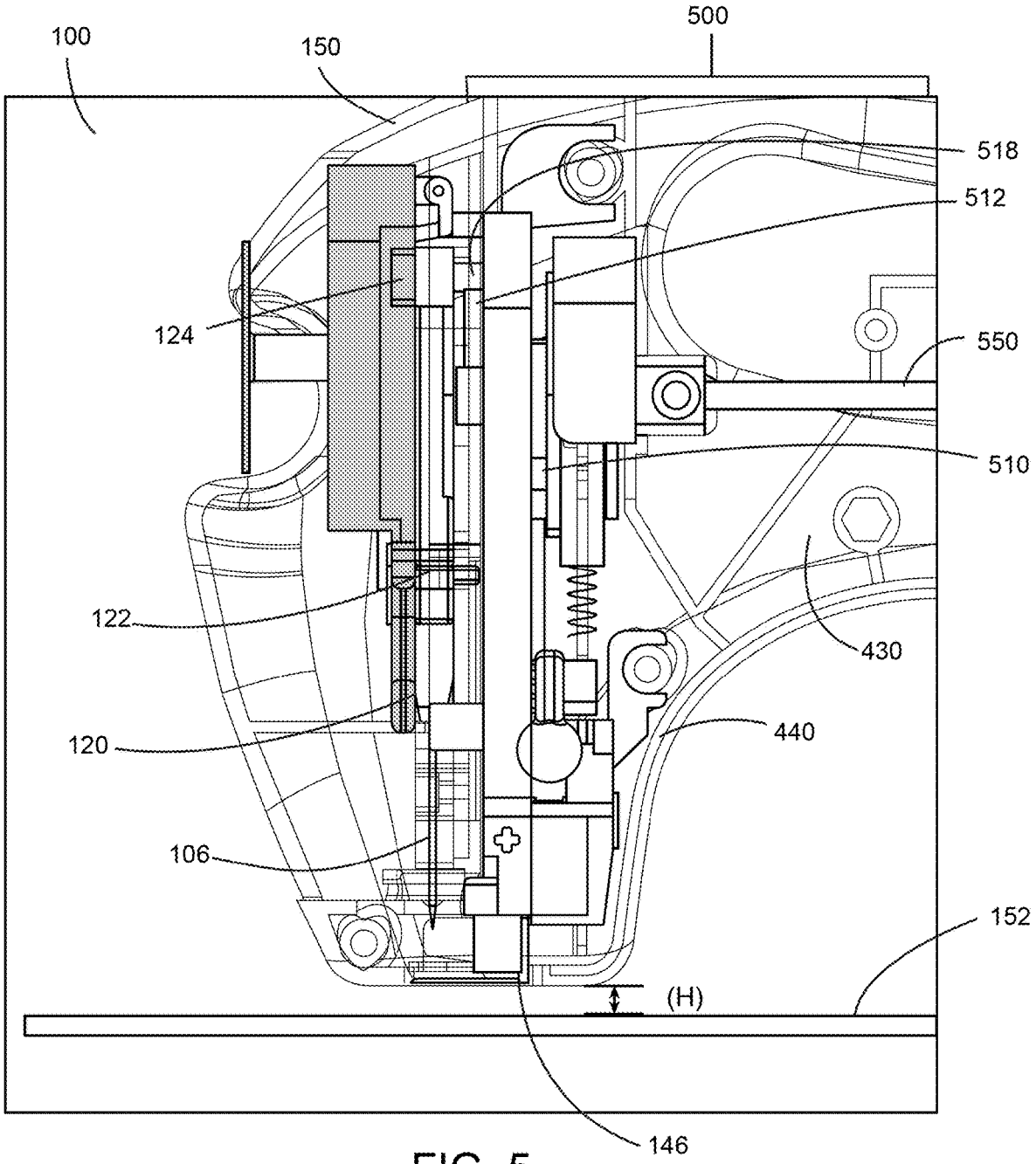
FIG. 5 shows an embodiment of sewing apparatus including the sewing mechanism enclosed within the head element of the housing.

Referring to the embodiment provided in FIG. 5, the head element 440 of the support arm extends downwards towards the sewing aperture 154 to an extent such that a spacing (H) between the bottom surface 244 of the head element 440 and the sewing platform 1542 is minimal. The spacing (H) is sufficiently large to allow for the insertion of the piece of fabric 110 to be sewn, but not so large as to permit insertion of fingers into proximity to sewing aperture 254 or the needle 106 within the head element 440. As shown in FIG. 5, when the needle holder 120 is in the withdrawn position, the needle 106 is fully retracted within the housing and is not visible within this spacing (H).

In an embodiment, the housing is formed of a plurality of housing portions. Specifically, the housing can be formed of two lateral housing portions, each portion forming half of the sewing platform 152, column 410, support arm 430 and head element 440.

In an additional embodiment, at least one side of an exterior of the housing 150 includes at least one removable cover element 260 through which at least part of the mechanisms contained within the housing 150 can be accessed.

As discussed above, the sewing apparatus 100 includes a needle holder driver 128 that is operatively connected to the needle holder 120 for driving a movement of the needle holder 120 between the withdrawn and advanced positions In an embodiment shown at least in FIG. 5, the needle holder driver 128 is operatively connected to the needle holder 120 via cam and shaft assembly 500.

Referring to the specific embodiments provided in FIGS. 5, 8, and 9A-9B, the cam and shaft assembly 500 can include a drive shaft 550 with a gearing mechanism 810 connected to a first end thereof and a cam unit 510 connected an opposing end thereof, wherein the cam unit 510 is operably connected to the needle holder 120 and the gearing mechanism 810 is operably connected to a driving body 820 for translation of a rotational motion therethrough.

In this embodiment, the needle holder 120 includes a cam connection that operably couples the motion of the needle holder 120 to the motion of the cam unit 510 in the cam and shaft assembly 500. The cam unit 510 includes a rotating cam disk 512 that is mounted to the connecting end of the driving shaft 550. The cam unit includes a first, central opening 516 through which the driving shaft 550 is mounted, and a cam contact element that couples the cam to the needle holder.

In the embodiment show in FIG. 5 and FIGS. 8A-8B the cam connection element of the needle holder 120 is a slot and the cam contact element is a pin 518 that is seated in the slot. The slot may be integrally formed in a rear surface of the needle holder 120 positioned proximate the cam unit 510. The pin 518 is mounted towards an exterior edge of the cam disk 512 and rotates together therewith. As the pin 518 rotates with the cam disk 512, the pin 518 interacts with the slot of the needle holder. The slot of the needle holder 120 defines a groove which receives the cam pin 518, where the cam pin 518 is slidably fixed within the groove to convert the rotary motion of cam unit 510 into a reciprocating motion of needle holder 120 between the withdrawn and advanced positions.

As the cam unit 510 is driven to rotate via the rotation of the driving shaft 550, the needle holder 120 is driven from the withdrawn position towards the advanced position. In an embodiment, one complete rotation of the driving shaft 550 and cam unit 510 produces a full motion of the needle holder 120 from the withdrawn position, to the advanced position and back to the withdrawn position. As the cam unit 510 rotates, the needle holder 120 will descend and when the cam unit 510 is halfway through its rotation, the needle holder 120 will have completed a full downward travel to the advanced positioned, and will have penetrated the piece of fabric 110 and fed the first thread segment 102*a* through the fabric 110 and the sewing aperture 154.

Figure 8:
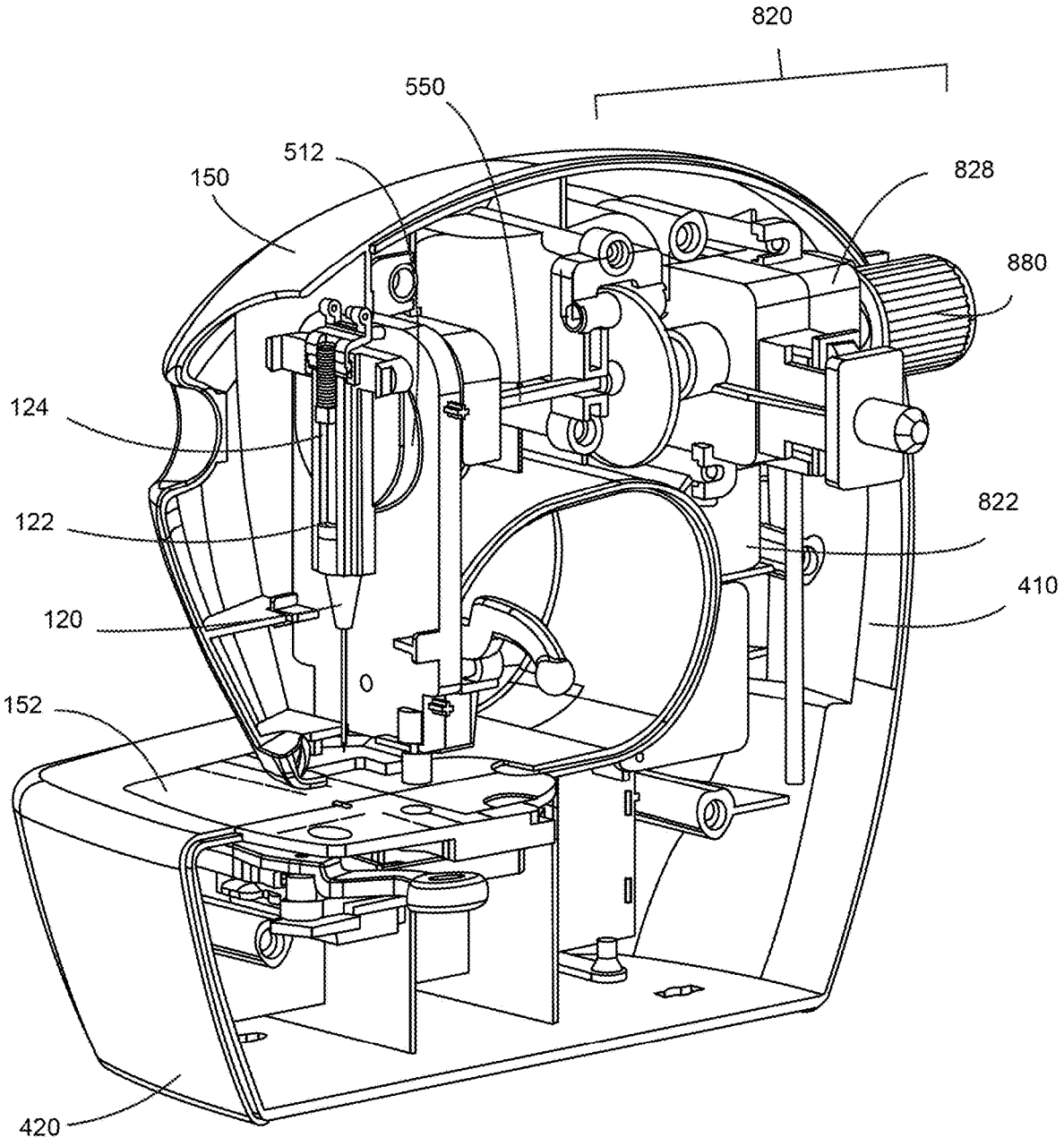
FIG. 8 shows a cut-out view of the embodiment of the sewing apparatus shown in FIG. 4.
Figure 9A:
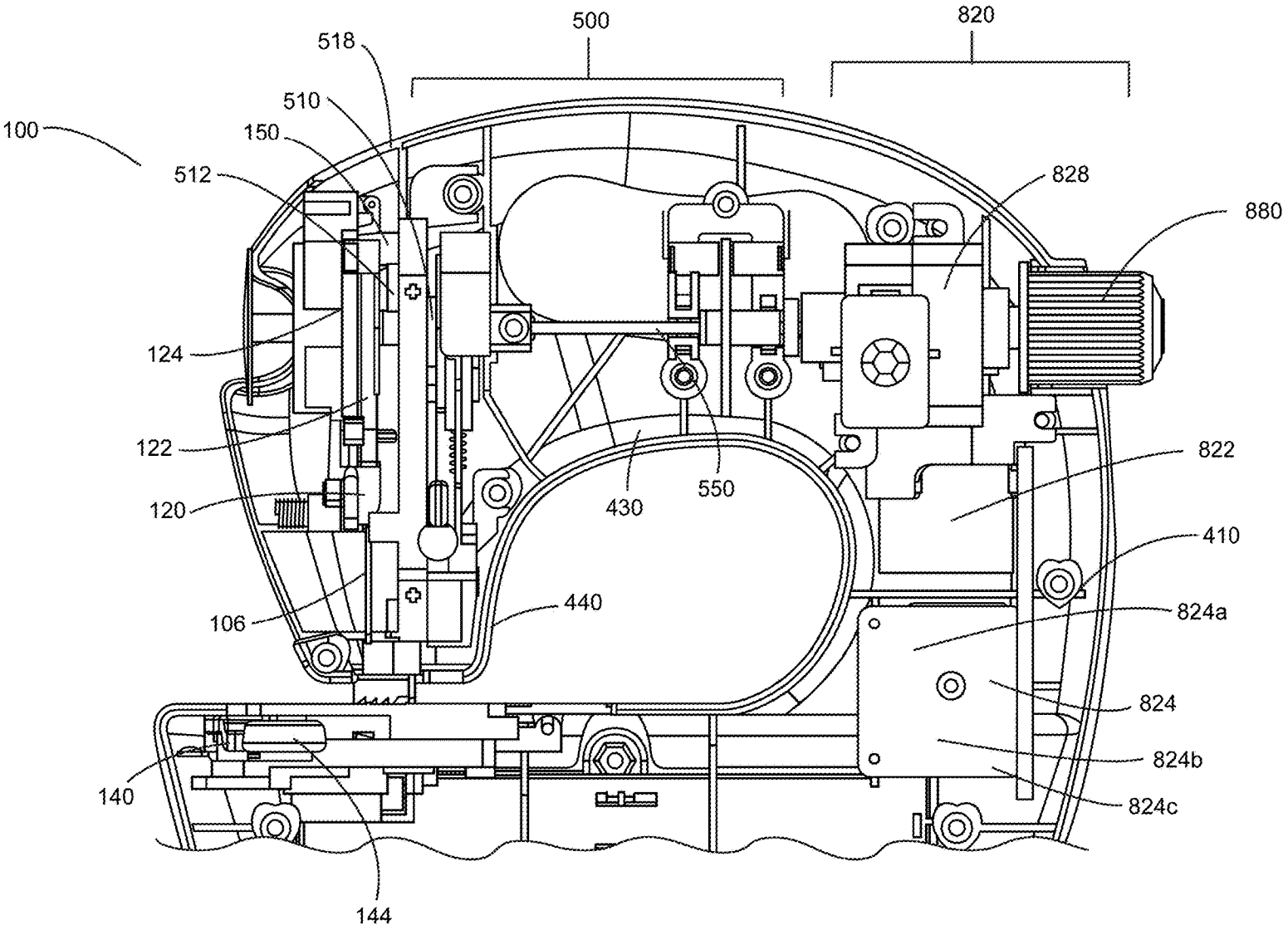
FIG. 9A shows a side, section view of an embodiment of the needle holder driver mounted within the housing.
Figure 9B:
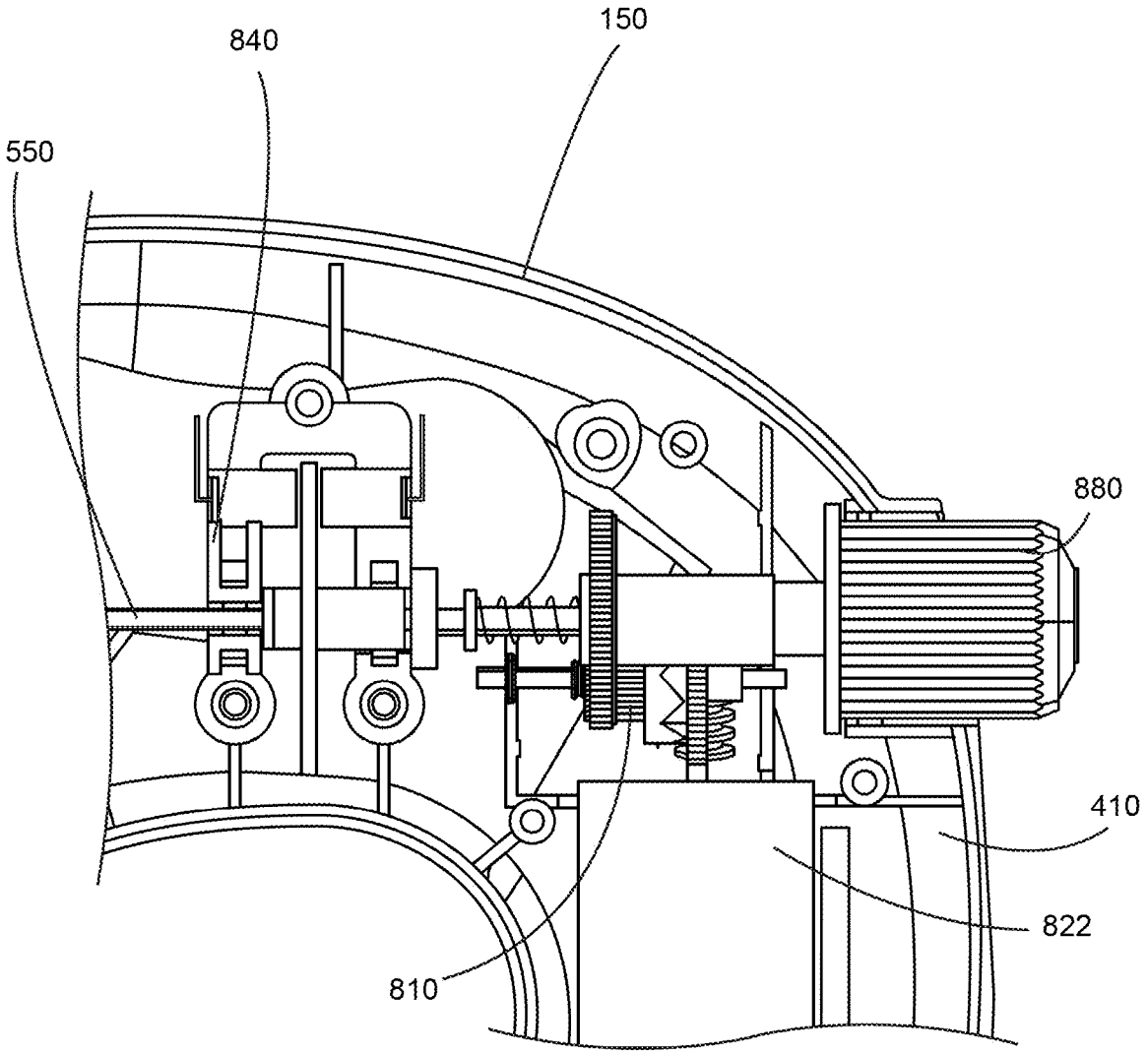
FIG. 9B shows a cut-out, side view of an embodiment of the gearing mechanism and manual driving element of the needle holder driver mounted within the housing.

In an embodiment shown in FIGS. 8 and 9A-9B, the driving body 820 of the needle holder driver is an electrically powered, driving mechanism including an electric motor 822 and a controller 824, the motor 822 being electrically connected to a controller 824 and the output of the electric motor being connected to the needle holder via the gearing mechanism 810, the drive shaft 550 and the cam unit 510. In the specific embodiment shown in FIGS. 8 and 9A, the electric motor 822 is positioned within the column 410 of the housing 150. The output of the electric motor 822 is operably connected to the gearing mechanism 810 of the cam and shaft assembly 500. In an embodiment shown in FIGS. 8 and 9A, the electric motor 822 and gearing mechanism 810 are mounted in a motor housing 826 and gearbox 828, both of which are suitably secured within column 410. The driving shaft 550 is suitably braced by a means of integral supports 840 formed on the interior of support arm 430.

In an embodiment, the controller 824 and electric motor 822 are electrically operated via a connection to an external, wall-mounted electric socket. In an alternate embodiment, the controller 824 and electric motor 822 are connected to a removable power source (such as at least one battery) that is positioned within the housing 150 of the sewing apparatus. Generally, the sewing apparatus 100 may is electrically controlled by means of a switch which connects the power source therein to the electric motor 822 for operation of the apparatus 100.

In an embodiment, the driving body of the needle holder driver is a manually driving element. In this embodiment, the end of the driving shaft 550 that is opposite the connecting end connected to the cam unit 510 is coupled to a manually driving element which extends at least partly from exterior of housing.

The manual driving element also includes an actuator portion and a grasping portion, the actuator portion being connected to the geared connection and being rotatably mounted to the housing. The grasping portion is connected to the housing and extends to the exterior of the housing for grasping by a user. In this embodiment, the user can drive the reciprocating motion of the needle holder between the withdrawn and advanced positions by holding and turning the grasping portion, which will drive a rotation of the actuator portion, which will in turn drive a rotation of the driving shaft and the cam unit.

In specific embodiment shown in FIGS. 8 and 9A-9B, the driving body is a rotatable handle 880, with the gearing mechanism 810 being coupled to the rotatable handle 880 for rotating the driving shaft 550.

In an additional embodiment, the driving body 820 of the needle holder driver 128 is a combined electrical and manual driving mechanism. Under a regular operating state, the needle holder driver 128 is electrically powered to drive the movement of the needle holder 120. However, the needle holder driver 128 is configured to shift from the regular operating state to a backup operating state, where the driving body 820 of the needle holder driver 128 is a manual driving element. The state switching may be applied for driving movement of needle holder 120 from withdrawn to advanced positions in the event that the electric motor 822 is not functioning or if the power supply to the motor 822 has been interrupted.

Figure 10A:
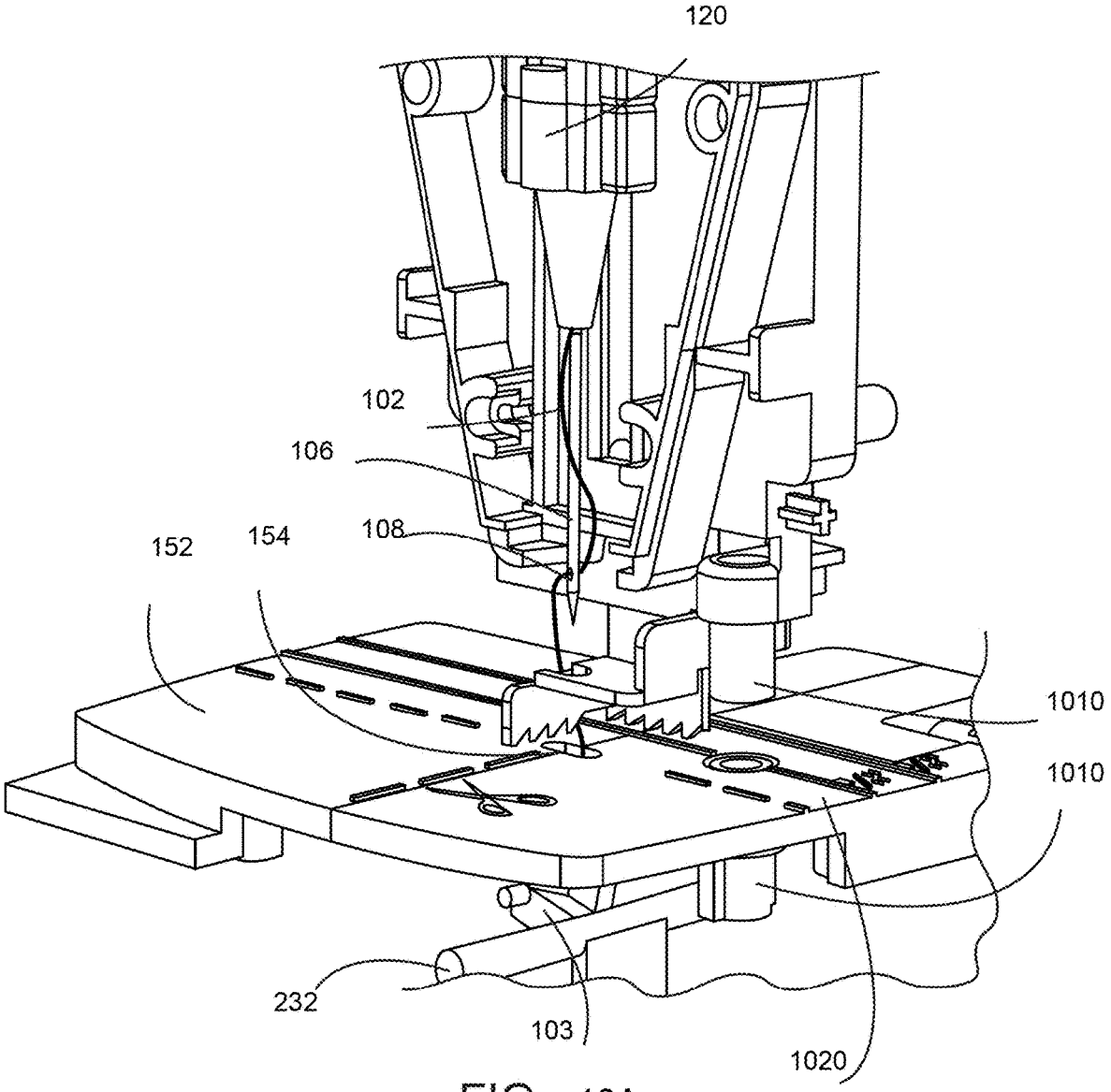
FIG. 10A shows a magnified perspective view showing a fabric detection sensor.
Figure 10B:
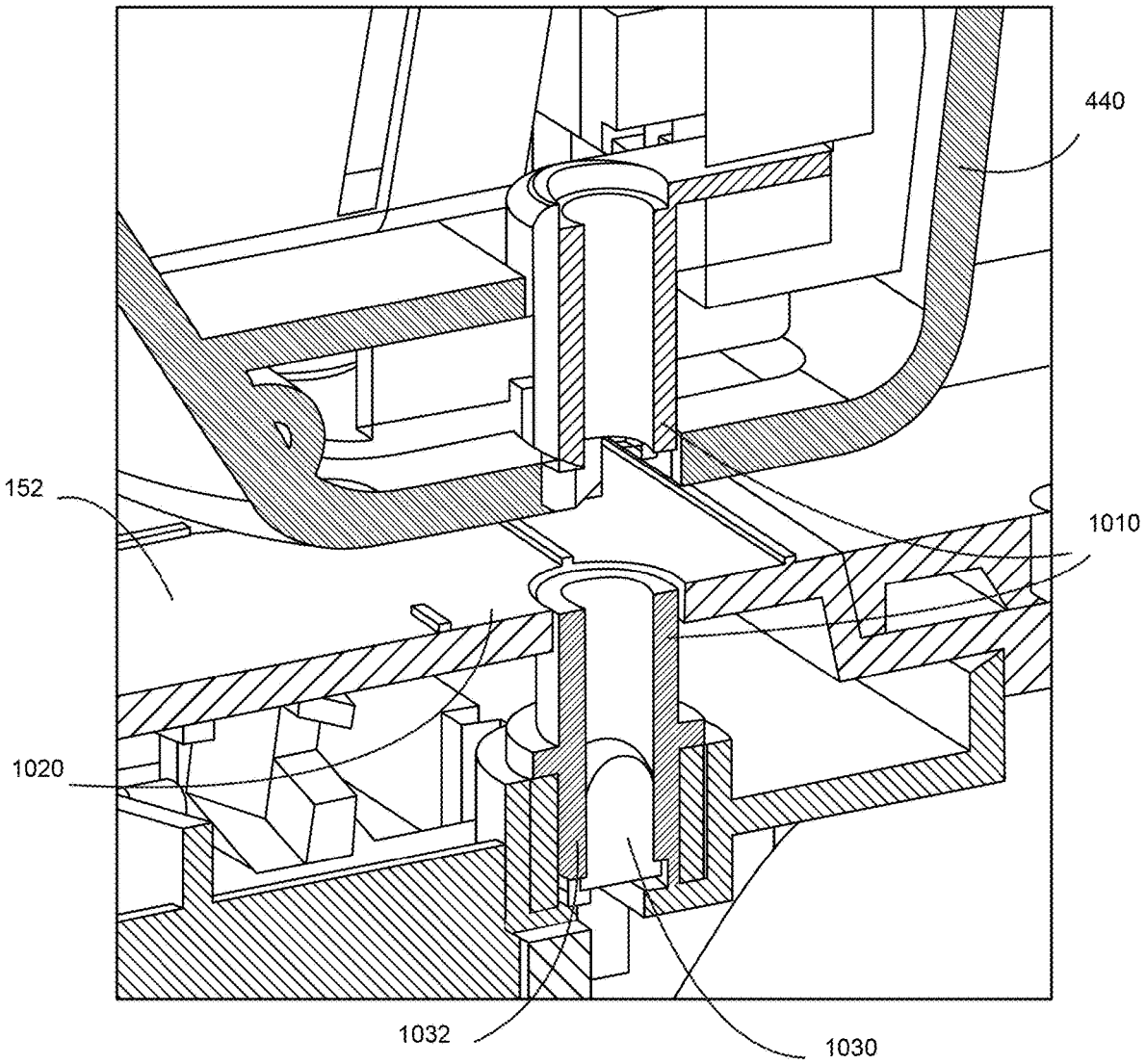
FIG. 10B shows another magnified perspective view showing the fabric detection sensor.

In the embodiment shown in FIGS. 10A and 10B, the sewing apparatus 1000 for applying a stitch of a thread to a piece of fabric includes a housing 150 with a sewing platform 152, a grasping member 130, a needle holder 120, a needle holder driver 128 and a fabric sensor 1010.

In this embodiment, the housing 150, grasping member 130, needle holder 120 and needle holder driver 128 all have similar structure and function to the embodiments described previously, where the needle holder driver 128 is operatively connected to the needle holder 120 to drive the needle holder 120 to move between withdrawn and advanced positions, for grasping of the first thread segment 102*a* by the grasping member 130.

Referring to the embodiment provided in FIGS. 10A and 10B, the sewing apparatus includes a needle holder driver 128 with a controller and an electrically powered driving mechanism. The housing 150 of the sewing apparatus is formed to include a feed-in section 1020 on a first side of the sewing aperture 156. The housing 150 also includes a fabric sensor 1020 positioned to detect the presence of a portion of the piece of fabric 110 on the platform feed-in section 1020.

In this embodiment, the controller is connected to the fabric detection sensor 1010 and the needle holder driver 128. The controller 824 includes a processor 824*a* for executing instructions and a memory 824*b* for storing instructions and data, both mounted to a PCB 824*c*, and which are electrically connected to each other. The controller 824 is programmed such that when a portion of the piece of fabric 110 is detected by the fabric detection sensor 1010, the needle holder driver 128 is engaged to move the needle holder 120 between the withdrawn position and the advanced position. The controller is further programmed with instructions to stop the needle holder driver 128 from driving the needle holder 120 based at least in part on a detection of no fabric by the fabric detection sensor 1010.

In the embodiments provided in FIGS. 10A, 10B, 11A and 11B, the fabric detection sensor 1010 includes first and second elements, positioned within the platform 152 and the head element 440, respectively. The first and second elements are aligned along a sensing axis 1012, wherein the presence of a piece of fabric may detected between the first and second sensing elements. In an embodiment shown in FIG. 11B, the first element of the sensor 1010 is a light detecting sensor, and the second element is a light-emitting element 1030 (such as an LED) that is positioned within a hollow, cylindrical housing 1032. The light detecting sensor in the first element will detect light produced by the light-emitting element 1030, where when light is detected, the controller logic will conclude that there is no fabric on the feed-in section 1020, and when the fabric is on the feed-in section 1020 and interrupts the light path between the first and second elements, the controller logic will conclude that there is a piece of fabric in the feed in section 1020.

In an alternate embodiment, the fabric sensor includes only one sensor element that is mounted in on of the sewing platform or the head element 440.

Figure 11A:
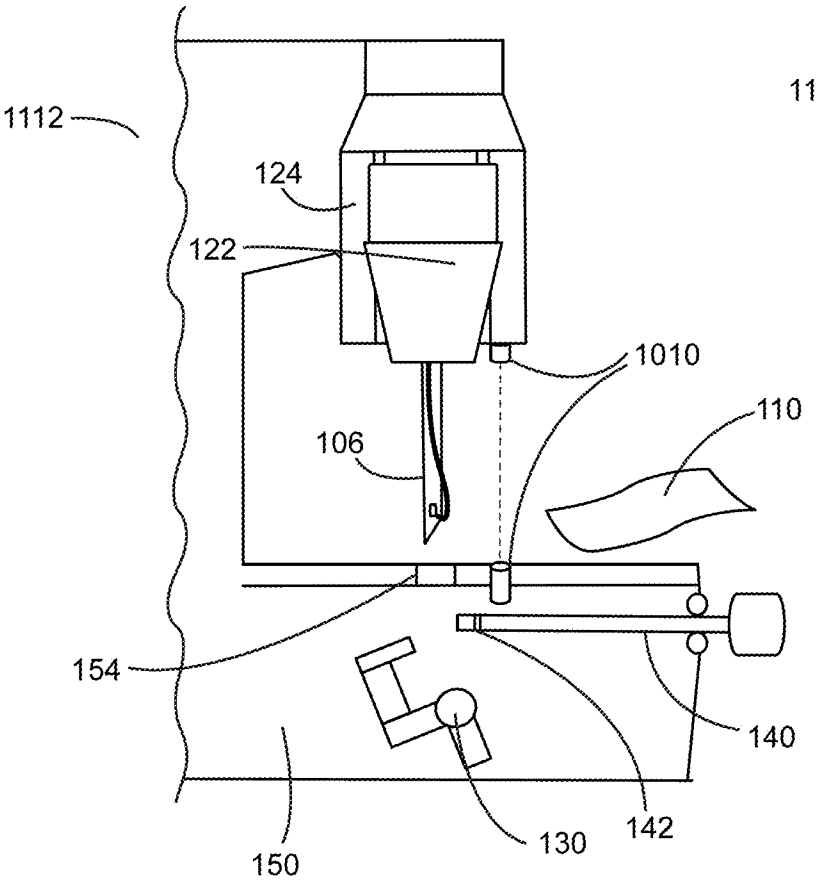

As shown in FIGS. 11A and 11B, the fabric detection sensor 1010, controller and electric driving body powering the needle holder driver 128 are used to control the driving of the needle holder 120 base on two possible, detected states (1110, 1112) of the sensor 110. In a second state 1112, when the presence of fabric is detected in the feed-in section 1020, the sensor 1010 will send a signal to the controller, and the controller will control the needle holder driver 128 to drive the needle holder 120. In a first state 1110, when a detection of no fabric by the fabric detection sensor 1010, the controller will control the needle holder driver 128 to stop driving the needle holder 120, thereby halting the sewing action of the sewing apparatus when there is no fabric to be sewn in the feed-in section 1020.

In an additional embodiment, the sewing apparatus 100 also includes a needle position sensor that is operably connected to one of the needle holder and the needle holder driver.

Figure 12A:
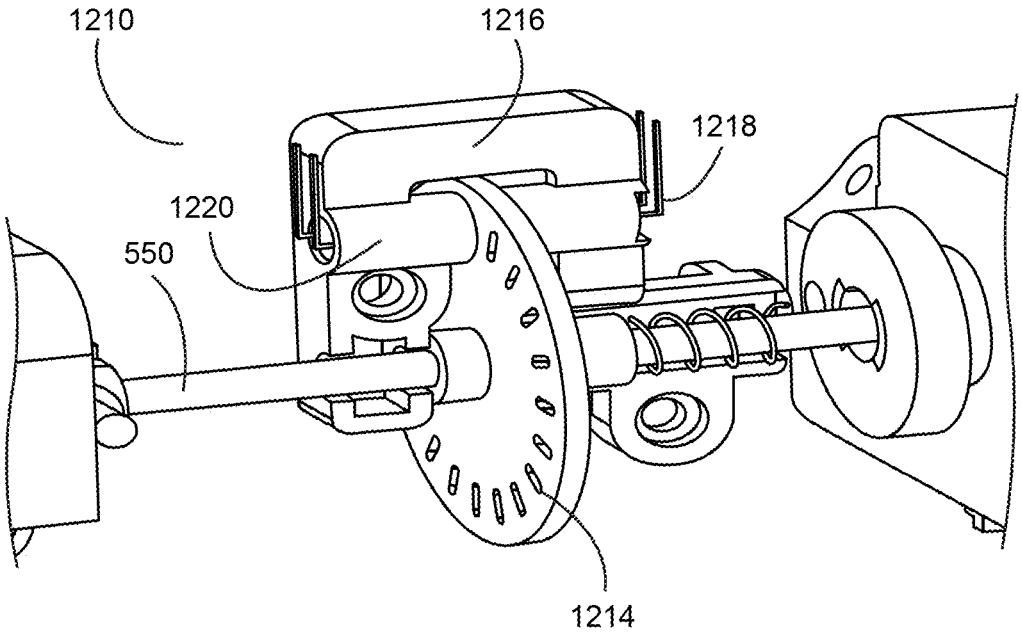
FIG. 12A shows an embodiment of the needle position sensor.
Figure 12B:
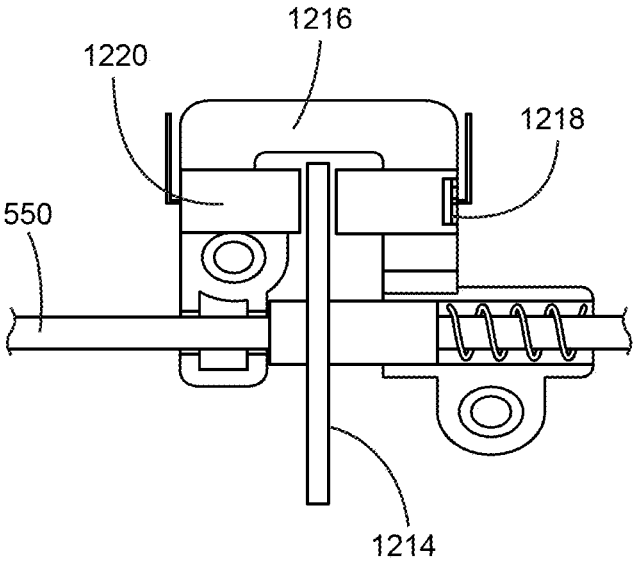
FIG. 12B shows a side-view of the embodiment of the needle position sensor of FIG. 12A.

Referring to FIGS. 12A and 12B, an embodiment of the needle position sensor 1210 in the form of a rotary encoder 1212 is provided. In this embodiment, the connection between the needle holder driver 128 and the needle holder 120 includes a drive shaft 550. The rotary encoder 1212 for sensing a position of the needle 106 is mounted to the driving shaft 550 to detect a position of the shaft 550 and to determine a position of the needle holder 120 and needle 106 therefrom. As the shaft 150 and needle holder 120 are coupled, each full rotation of the shaft 550 will be associated with a particular vertical movement of the needle holder 120. In this embodiment, the rotary encoder 1212 includes a slotted disk 1214 mounted on the shaft and an encoder housing 1216 including at least one light source 1218, a photodetector assembly 1220 and circuitry 1222 for controlling the light source and the photodetector assembly.

In the embodiment provided in FIG. 12A/B, the needle position sensor 1210 is connected to the controller for determining a position of the needle 106 as held by the needle holder 120. The controller is further programmed to stop the needle holder driver 128 from driving the needle holder 120, based at least in part on both of the following conditions being true: a detection of no fabric by the fabric detection sensor; and, a detection that the needle is outside of the piece of fabric by the needle position sensor. In this way, the needle position sensor 1210 precludes the possibility of the motor 822 of the needle holder driver 128 being de-energized until the needle 106 is retracted within the housing 150.

In an additional embodiment, the two conditions are: a detection of no fabric by the fabric detection sensor; and, a detection that the needle holder is in the withdrawn positions by the needle position sensor.

In this embodiment, the needle holder driver 128 will not shutoff and halt the motion of the needle holder 120 and needle 106 until the needle holder 120 has been moved to the withdrawn position within the housing 150.

Additional embodiments of the sewing apparatus may include various removable cartridges can be supplied which hold a spool of thread, a needle and a needle holder apparatus.

In an embodiment provided in FIGS. 13A-13B and 14A-14B, the sewing apparatus further comprises a thread cartridge 1310 with a thread cartridge mechanism 1410 enclosed by a thread cartridge housing 1320. The thread cartridge mechanism 1410 including a spool 1412 holding at least an end segment of the thread, the spool 1412 being rotatably mounted on a shaft 1414 that is integrally formed with the thread cartridge housing 1310. The thread cartridge 1310 is also configured to house the needle holder 120 (as discussed above), where the needle holder 120 is mounted within the thread cartridge 1310 to move from a withdrawn to an advanced position relative to the cartridge 1310.

Figure 13A:
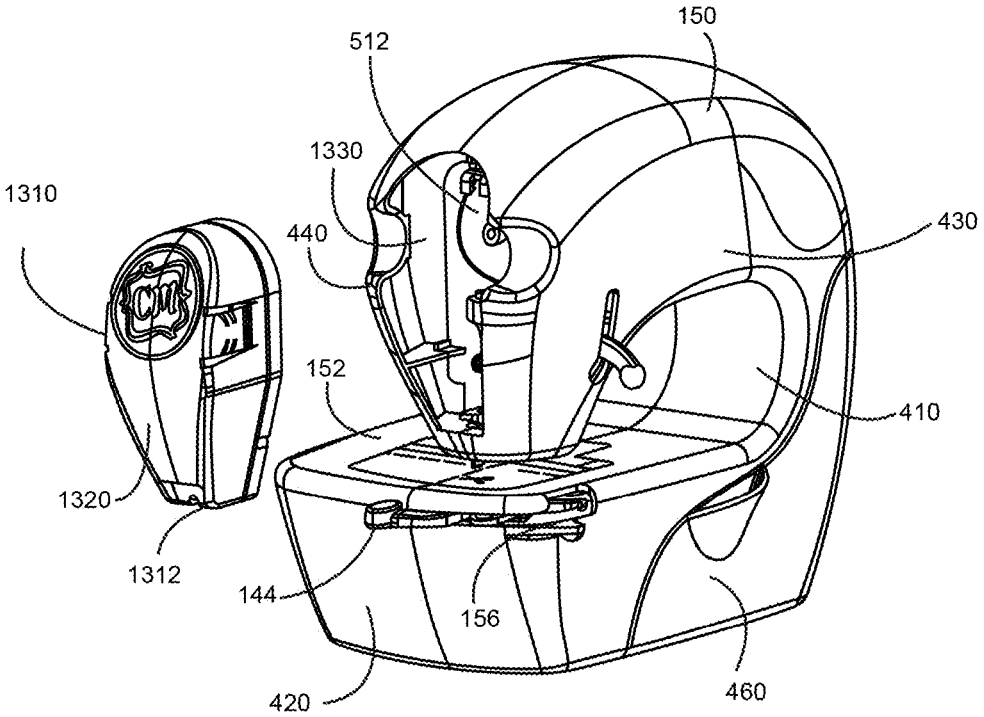
FIG. 13A shows an embodiment of the thread cartridge that is removed from the recess of the housing.
Figure 13B:
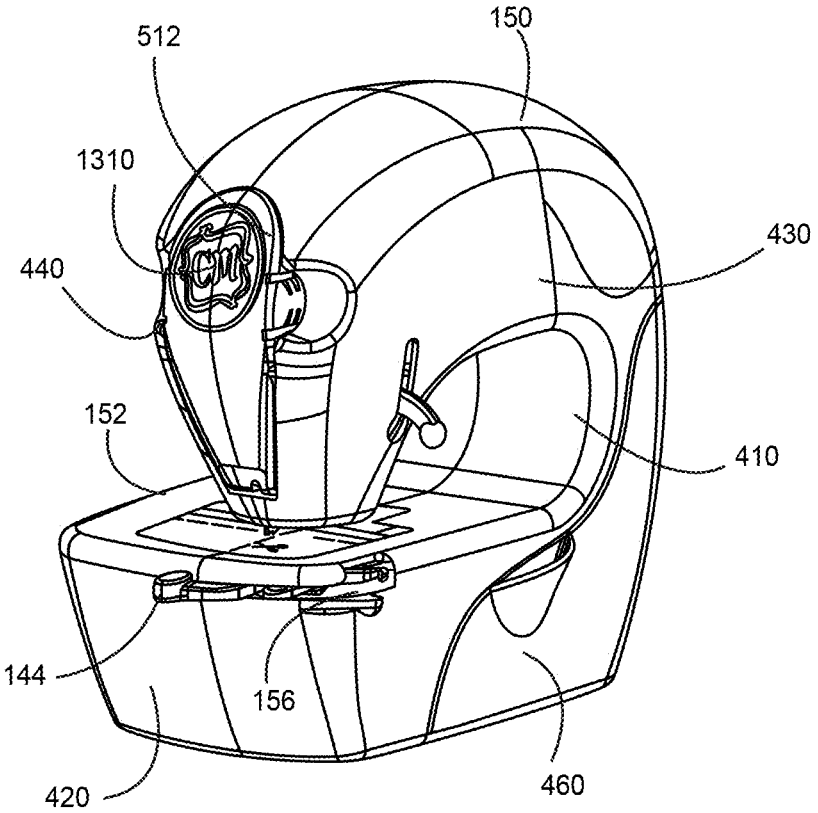
FIG. 13B shows an embodiment of the thread cartridge that is mounted in the recess of the housing.
Figure 14A:
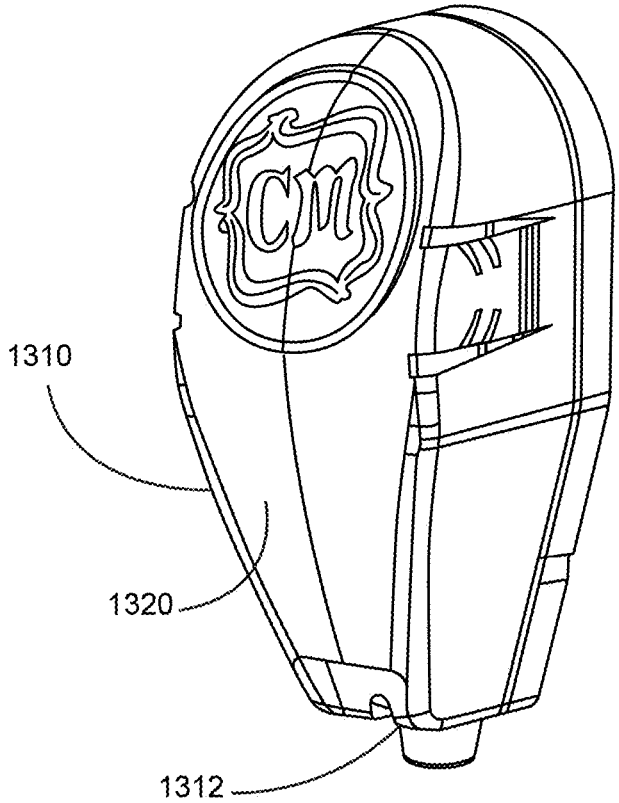
FIG. 14A shows an embodiment of the thread cartridge.
Figure 14B:
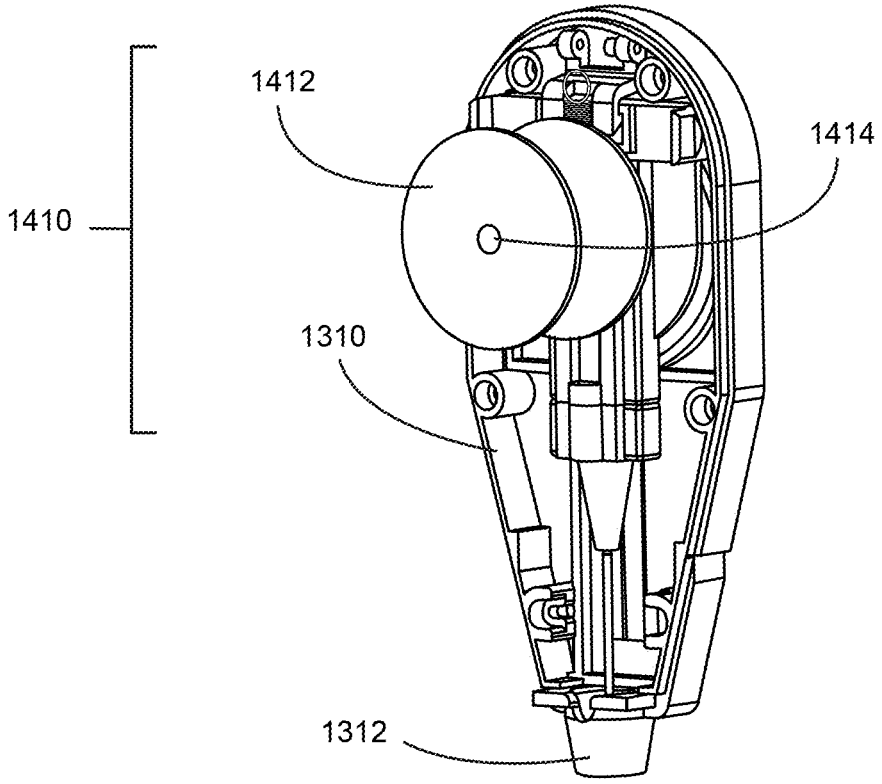
FIG. 14B shows an embodiment of the interior mechanism contained within the thread cartridge.

As shown in FIGS. 13A and 13B, the thread cartridge 1310 is formed to be removable from the housing 150 of the sewing apparatus 100, where the housing 150 includes a recess 1330 in which the thread cartridge 1310 can be securely received. The thread cartridge 1310 may releasably connectable to the column or the head element 440 of the housing. As shown in FIGS. 13A and 13B, the recess 1330 in which the thread cartridge 1310 can be securely received is positioned within the head element 440 of the support arm 430 of the housing 150 and includes at least a recessed, vertical surface 1332 therewithin, and an outwardly projecting ledge 1334 at a bottom of the recessed surface 1332. The recessed surface 1332 is adapted to frictionally receive and retain the thread cartridge 1310 thereon, where the ledge 1334 is shaped to engage the bottom surface 1312 of a cartridge 1310. In this embodiment, the thread cartridge housing 1320 will include a generally planar, rear surface which abuts against the recessed surface 1332. The thread cartridge housing 1320 may also include a front surface 1322 with a curvature that matches the curvature of the section of the housing 150 that includes the recess 1330 for receiving the thread cartridge 1310. The thread cartridge 1310 will also include a connecting element for operably connecting the needle holder 120 in the thread cartridge 1310 with the needle holder driver 128 housed within the main housing 150 of the sewing apparatus 100. This connecting element may have the form of a gap in the thread cartridge 1310 housing through which a slot in the thread cartridge 1310 may be accessed. The thread cartridge 1310 may be mounted to the head element 440 of the support arm 430 such that a connecting pin from the cam unit 510 is securely received in the slot of the thread cartridge 1310 for driving an actuation of the needle holder 120 contained therewithin.

In the embodiment, the thread cartridge 1310 includes an aperture on a bottom side 1312 thereof, through which the needle 106 held by the needle holder 120 will pass through when the needle holder 120 is moved between the withdrawn and advanced positions. The aperture of the thread cartridge 1310 will be formed on the cartridge housing 1320 such that when the thread cartridge 1310 is fully received within the recess 1330 of the housing 150, the aperture in the cartridge 1310 will be vertically aligned with the sewing aperture 154 of the sewing platform 152.

In an embodiment, the cartridge includes a needle 106 that is pre-threaded with a first thread segment 102*a*, the first thread segment 102*a* being part of a length of thread that is wound around the spool such that the cartridge is formed for immediate use by a user when it is mounted on the housing.

In an embodiment, the thread cartridge 1310 of the sewing apparatus 100 is a plurality of thread cartridges 1310, each supplied with spools 1412 containing threads of various colors, where the cartridge 1310 that is held in the housing 150 can be removed and replaced to accomplish different desired sewing functions by a user.

While it is described for the stitch to be formed on a piece of fabric 110, it will be understood that, in use, it is contemplated that the stitch will be formed on a plurality of pieces of fabric 110 in order to sew them together. The term 'a piece of fabric' is intended to include the situation where the stitch is applied to a plurality of pieces of fabric 110 to sew them together.

The above-described embodiments are intended to be examples of the present invention and alterations and modifications may be effected thereto, by those of skill in the art, without departing from the scope of the invention that is defined solely by the claims appended hereto.

What is claimed is:

1. A sewing apparatus for applying a stitch of a thread to a piece of fabric, the sewing apparatus comprising:

a housing including a platform with a sewing aperture, the platform being positioned for supporting the piece of fabric, the housing further including an access aperture;

a grasping member movable between a grasping position in which the grasping member grasps a first thread segment below the sewing aperture, and a release position in which the grasping member releases the first thread segment about a second thread segment to form a segment of the stitch;

a thread puller including a securing feature, wherein the thread puller is movable from a first position in which the thread puller permits movement of the first thread segment within the housing below the sewing aperture, and a second position in which the thread puller drives the securing feature to pull the first thread segment through the access aperture to an exterior of the housing so as to permit a user to cut the first thread segment;

a needle holder that is positioned to hold a needle that has a needle aperture for pass-through, therethrough of the first thread segment, wherein the needle holder is movable between a withdrawn position in which the needle holder holds the needle outside of the piece of fabric and an advanced position in which the needle holder drives the needle through the piece of fabric and through the sewing aperture to bring a second thread segment below the sewing aperture and into position for grasping by the grasping member; and a needle holder driver that is operatively connected to the needle holder to drive the needle holder to move between the withdrawn and advanced positions.

2. The sewing apparatus as claimed in claim 1, wherein the grasping member is a looping hook that reciprocates between the grasping position and the release position, such that the stitch that is formed in the piece of fabric is a chain stitch.

3. The sewing apparatus as claimed in claim 1, further comprising a tensioning element positioned to apply tension to the first thread segment between a thread spool and the needle to limit an unwinding of thread from the spool when the securing end of the thread puller moves to the second position.

4. The sewing apparatus as claimed in claim 1, wherein the thread puller is slidable between the first and second positions.

5. The sewing apparatus as claimed in claim 1, wherein the thread puller is pivotable between the first and second positions.

6. The sewing apparatus as claimed in claim 1, wherein the housing includes a detent positioned to releasably hold the thread puller in the second position.

7. A sewing apparatus as claimed in claim 6, wherein the housing further includes a column extending vertically from the platform, and a support arm extending out from the column overtop the sewing aperture, the needle holder being is positioned within the support arm.

8. A sewing apparatus as claimed in claim 7, wherein the needle holder driver includes an electric motor that is positioned within the column of the housing, an output of the electric motor being operably coupled to the needle holder.

9. A sewing apparatus as claimed in claim 8, wherein the needle holder driver is operatively connected to the needle holder via a rotating shaft assembly, the rotating shaft assembly including a drive shaft with a gearing mechanism connected to a first end thereof and a cam connected an opposing end thereof, wherein the cam is operably connected to the needle holder and the gearing mechanism is operably connected to the output of the electric motor.

10. A sewing apparatus as claimed in claim 6, further comprising a thread cartridge including a spool holding at least an end segment of the thread, wherein the thread cartridge is releasably connectable to the column of the housing and wherein the needle holder is housed within the thread cartridge.

11. A sewing apparatus as claimed in claim 1, wherein the needle holder includes a biasing member connected to bias the needle holder towards the withdrawn position.

* * * * *